US012247486B2

(12) United States Patent
Crockett et al.

(10) Patent No.: US 12,247,486 B2
(45) Date of Patent: Mar. 11, 2025

(54) BOLSTERS FOR DEGRADATION PICKS

(71) Applicant: Schlumberger Technology Corporation, Sugar Land, TX (US)

(72) Inventors: Ronald Crockett, Mt. Pleasant, UT (US); Francis E. Leany, Provo, UT (US); Dwain Norris, Provo, UT (US); Braeden Brown, Provo, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 243 days.

(21) Appl. No.: 17/604,422

(22) PCT Filed: Apr. 28, 2020

(86) PCT No.: PCT/US2020/030190
§ 371 (c)(1),
(2) Date: Oct. 17, 2021

(87) PCT Pub. No.: WO2020/223189
PCT Pub. Date: Nov. 5, 2020

(65) Prior Publication Data

US 2022/0178255 A1 Jun. 9, 2022

Related U.S. Application Data

(60) Provisional application No. 62/840,524, filed on Apr. 30, 2019.

(51) Int. Cl.
*E21C 35/183* (2006.01)
*E01C 23/088* (2006.01)
(Continued)

(52) U.S. Cl.
CPC ..... *E21C 35/1837* (2020.05); *E01C 23/088* (2013.01); *E01C 23/127* (2013.01);
(Continued)

(58) Field of Classification Search
CPC ..... E01C 23/088; E01C 23/127; E21C 35/18; E21C 35/1831; E21C 35/1833;
(Continued)

(56) References Cited

U.S. PATENT DOCUMENTS 4,702,525 A * 10/1987 Sollami ..... E21C 35/183 299/111
6,354,771 B1 3/2002 Bauschulte et al.
(Continued)

FOREIGN PATENT DOCUMENTS

CN 203161093 U * 8/2013
WO WO-2013112188 A2 * 8/2013 ..... B28D 1/188

OTHER PUBLICATIONS

English Language Machine Translation of Yu et al., CN-203161093-U, published Aug. 28, 2013 (4 pages) (Year: 2013).*
(Continued)

*Primary Examiner* — Janine M Kreck
*Assistant Examiner* — Michael A Goodwin
(74) *Attorney, Agent, or Firm* — Jeffrey D. Frantz

(57) ABSTRACT

A bolster for a degradation pick includes a transverse cross section that is non-circular. Non-circular cross sections include square, triangular, hexagonal and other shapes. The bolster is made from a wear and/or erosion resistant material. The wear and/or erosion resistant material helps to protect the shank of the degradation pick. The bolster has a matching shape to the shape of the shank of the degradation pick.

14 Claims, 19 Drawing Sheets

(51) Int. Cl.
*E01C 23/12* (2006.01)
*E21C 35/19* (2006.01)

(52) U.S. Cl.
CPC ..... *E21C 35/1831* (2020.05); *E21C 35/1835* (2020.05); *E21C 35/19* (2013.01)

(58) Field of Classification Search
CPC .. E21C 35/1835; E21C 35/1837; E21C 35/19; E21C 35/183; E21C 35/1933; E21C 35/1936; B28D 1/186; B28D 1/188
See application file for complete search history.

(56) References Cited

U.S. PATENT DOCUMENTS 7,396,086 B1 7/2008 Hall et al.
7,669,938 B2 3/2010 Hall et al.
8,123,302 B2 2/2012 Hall et al.
8,646,848 B2 2/2014 Hall et al.
8,668,275 B2 3/2014 Hall et al.
10,648,330 B1 * 5/2020 Weaver ..... E21C 35/1833
10,968,738 B1 * 4/2021 Sollami ..... E21C 35/1831
2004/0026983 A1 2/2004 McAlvain
2008/0036280 A1 * 2/2008 Hall ..... E21C 35/19 299/105
2008/0164748 A1 * 7/2008 Hall ..... E21B 10/633 299/104
2009/0066149 A1 * 3/2009 Hall ..... E21C 35/197 175/414
2009/0256413 A1 * 10/2009 Majagi ..... B28D 1/188 299/111
2013/0300183 A1 * 11/2013 Rowlett ..... E21C 35/18 299/105
2018/0202290 A1 * 7/2018 Sollami ..... E01C 23/088
2018/0245467 A1 * 8/2018 Kenno ..... E21C 35/1837

OTHER PUBLICATIONS

International Search Report and Written Opinion issued in International Patent application PCT/US2020/030190 on Aug. 3, 2020 , 14 pages.

* cited by examiner

BOLSTERS FOR DEGRADATION PICKS

CROSS-REFERENCE TO RELATED APPLICATIONS

This application is a national stage entry under 35 U.S.C. 371 of International Application No. PCT/US2020/030190, filed Apr. 28, 2020, which claims priority to and the benefit of U.S. Provisional Application No. 62/840,524, filed on Apr. 30, 2019, the entirety of which is incorporated herein by reference.

BACKGROUND OF THE DISCLOSURE

Mining and material excavation is the process of breaking down material from a solid whole and removing the material. One method of excavation involves scraping a hardened pick against the surface of a material to remove the material. As the material is degraded, it may be conveyed or hauled away for processing or disposal. After removal of the material, more material may be eroded or scraped away, and the process repeated.

SUMMARY

In some embodiments, a bolster includes a transverse cross-sectional shape that is noncircular. In other embodiments, a bolster includes a transverse cross-sectional shape that is non-rotationally symmetrical about a central axis.

In yet other embodiments, a bolster includes a bolster body that has a bolster feature. The bolster is configured to connect to a pick body at an interface. The pick body has a transverse cross-sectional shape that includes at least one pick body feature. The bolster feature is similar to the pick body feature.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 6-1 is a longitudinal cross-sectional view of a degradation pick, according to at least one embodiment of the present disclosure;

FIG. 6-2 is another longitudinal cross-sectional view of a degradation pick, according to at least one embodiment of the present disclosure;

FIG. 6-3 is still another longitudinal cross-sectional view of a degradation pick, according to at least one embodiment of the present disclosure;

FIG. 7-1 is a perspective view of another degradation pick, according to at least one embodiment of the present disclosure;

FIG. 7-2 is a perspective view of a bolster from FIG. 7-1, according to at least one embodiment of the present disclosure;

FIG. 8-1 is a perspective view of a bolster, according to at least one embodiment of the present disclosure;

FIG. 8-2 is a cross-sectional view of the bolster of FIG. 8-1, according to at least one embodiment of the present disclosure;

FIG. 9-1 is a perspective view of a bolster, according to at least one embodiment of the present disclosure;

FIG. 9-2 is a cross-sectional view of the bolster of FIG. 9-1, according to at least one embodiment of the present disclosure;

FIG. 10-1 is a perspective view of a bolster, according to at least one embodiment of the present disclosure;

FIG. 10-2 is a cross-sectional view of the bolster of FIG. 10-1, according to at least one embodiment of the present disclosure;

FIG. 11-1 is a perspective view of a bolster, according to at least one embodiment of the present disclosure;

FIG. 11-2 is a cross-sectional view of the bolster of FIG. 11-1, according to at least one embodiment of the present disclosure;

FIG. 12-1 is a perspective view of a bolster, according to at least one embodiment of the present disclosure;

FIG. 12-2 is a cross-sectional view of the bolster of FIG. 12-1, according to at least one embodiment of the present disclosure;

FIG. 13-1 is a perspective view of a bolster, according to at least one embodiment of the present disclosure;

FIG. 13-2 is a cross-sectional view of the bolster of FIG. 13-1, according to at least one embodiment of the present disclosure;

FIG. 14-1 is a perspective view of a bolster, according to at least one embodiment of the present disclosure;

FIG. 14-2 is a cross-sectional view of the bolster of FIG. 14-1, according to at least one embodiment of the present disclosure;

FIG. 15-1 is a perspective view of a bolster, according to at least one embodiment of the present disclosure;

FIG. 15-2 is a cross-sectional view of the bolster of FIG. 15-1, according to at least one embodiment of the present disclosure;

FIG. 16-1 is a perspective view of a bolster, according to at least one embodiment of the present disclosure; and FIG. 16-2 is a cross-sectional view of the bolster of FIG. 16-1, according to at least one embodiment of the present disclosure.

DETAILED DESCRIPTION

Figure 1:
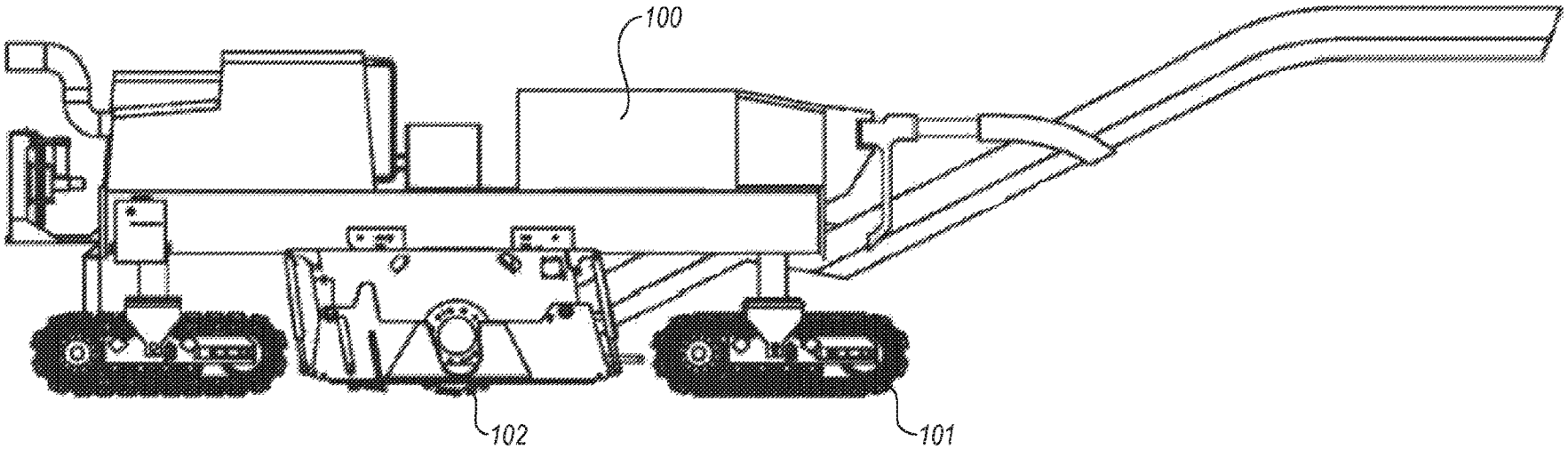
FIG. 1 is a road milling machine, according to at least one embodiment of the present disclosure.

This disclosure generally relates to devices, systems, and methods for bolsters used to protect degradation picks from wear during operation. FIG. 1 shows an embodiment of a road milling machine 100 of the type commonly used to engage and degrade asphalt or concrete to construct or resurface roads and other large surfaces. The road milling machine 100 may be supported and transported by continuous tracks 101, wheels or other means known in the art. A rotatable drum 102 may be secured to an underside of the road milling machine 100 with a plurality of degradation picks attached to an exterior thereof. As the rotatable drum 102 is rotated, the degradation picks may repeatedly engage a surface upon which the road milling machine 100 is traveling.

Figure 2:
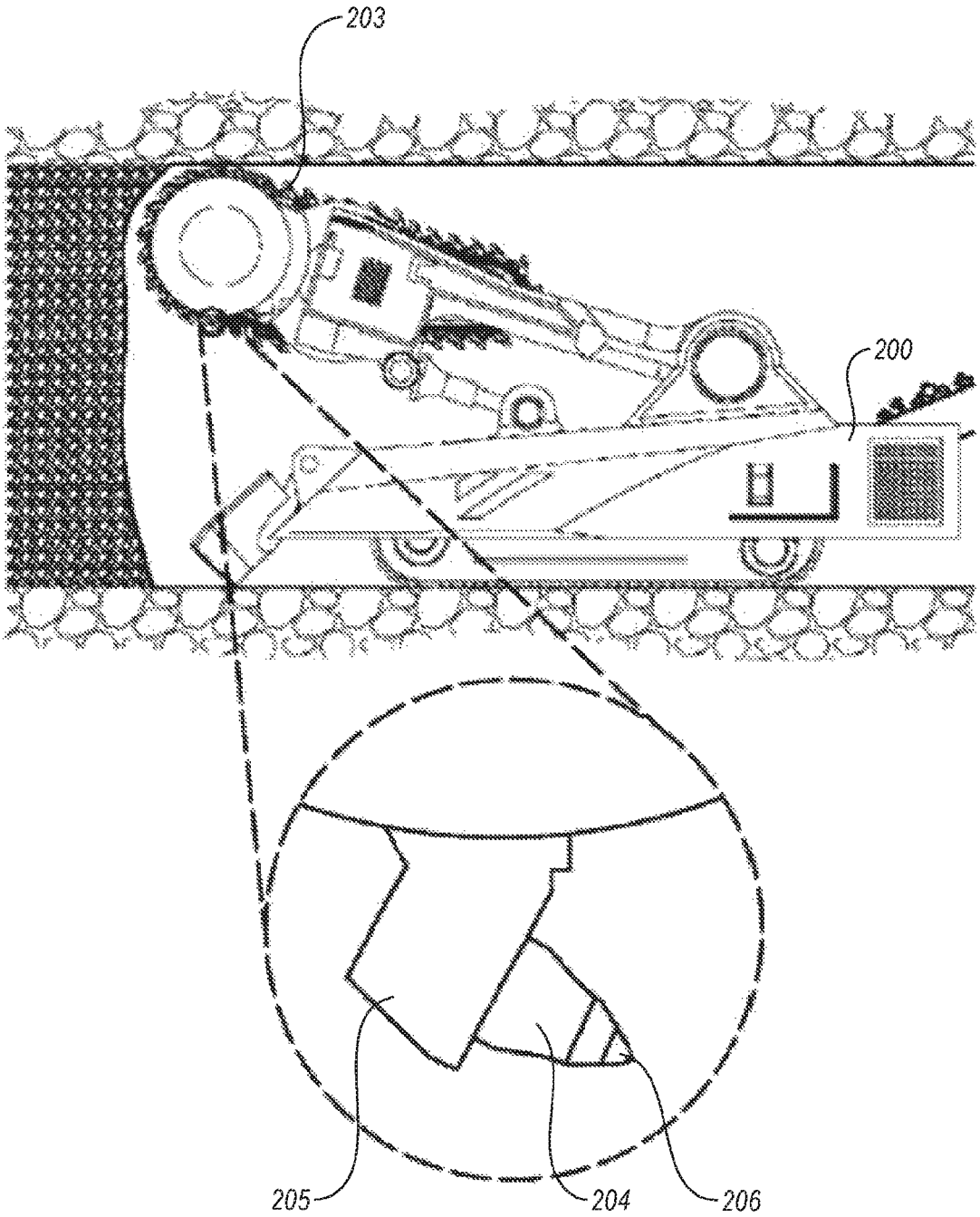
FIG. 2 is a mining machine, according to at least one embodiment of the present disclosure.

FIG. 2 shows an embodiment of a mining machine 200 of the type commonly used to engage and degrade rock and other subterranean formations to extract valuable materials from the earth. The mining machine 200 may comprise a continuous chain 203 with a plurality of degradation picks 204 (shown in magnified view) secured thereto. Each of the degradation picks 204 may comprise a hardened tip 206 designed for repeated engagement with a tough material. Such repeated engagement may break up the tough material into aggregate pieces that may be removed. Each of the degradation picks 204 may also comprise a generally cylindrical shank opposite the hardened tip 206 that may be disposed within a bore within a block 205 that is rigidly fixed to the continuous chain 203.

Figure 3:
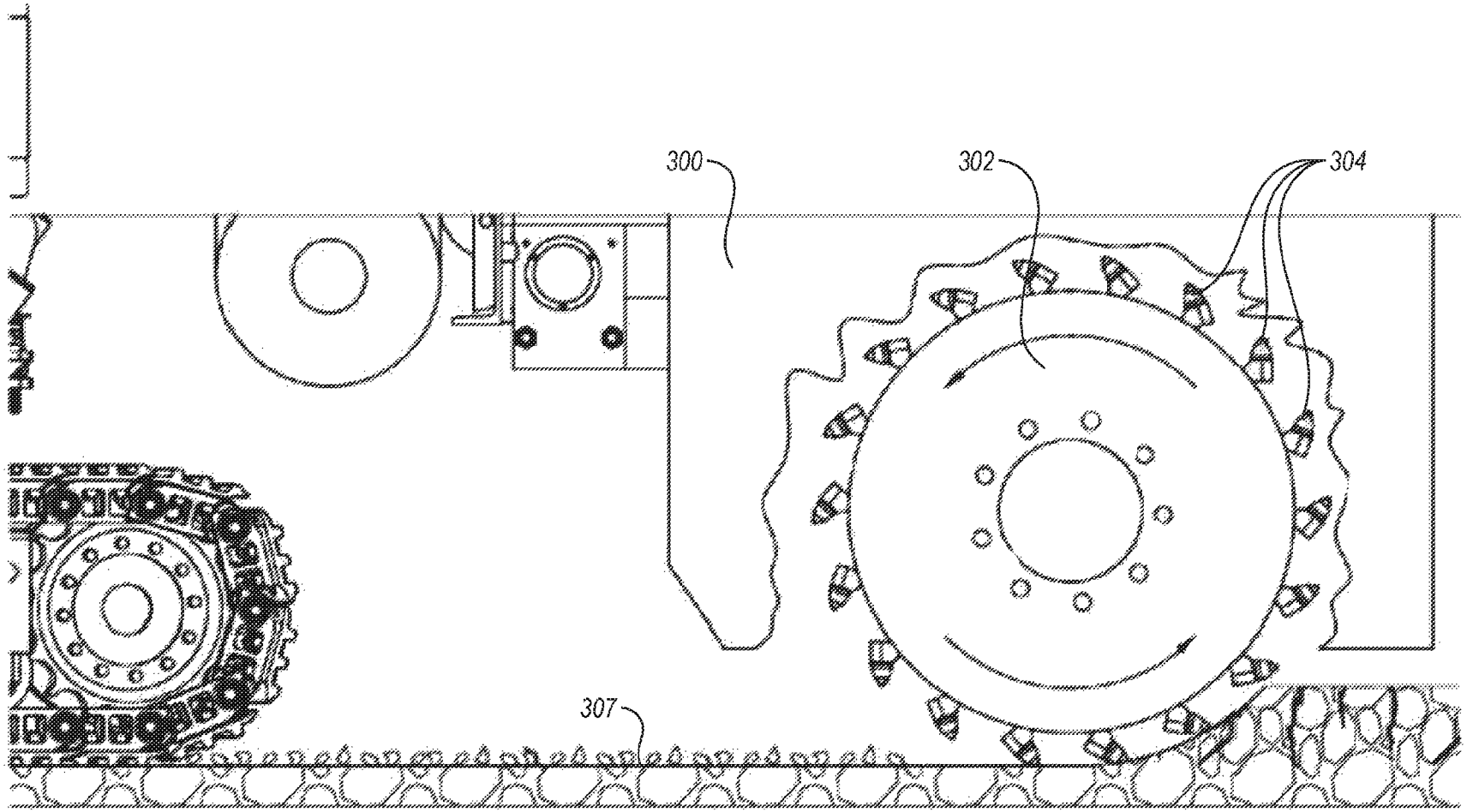
FIG. 3 is a rotatable drum, according to at least one embodiment of the present disclosure.

FIG. 3 shows an embodiment of a rotatable drum 302 secured to an underside of a road milling machine 300. The road milling machine 300 may rotate the rotatable drum 302 around an axis generally parallel to a surface 307 upon which the road milling machine 300 may travel. The rotatable drum 302 may comprise a plurality of degradation picks 304 secured around an exterior thereof. As the rotatable drum 302 rotates, the degradation picks 304 may repeatedly impact the surface 307 which may comprise tough material of any variety such as asphalt or concrete. The repeated impact of degradation picks 304 against the surface 307 may allow the plurality of degradation picks 304 to degrade the surface 307 and break it into aggregate pieces.

Figure 4:
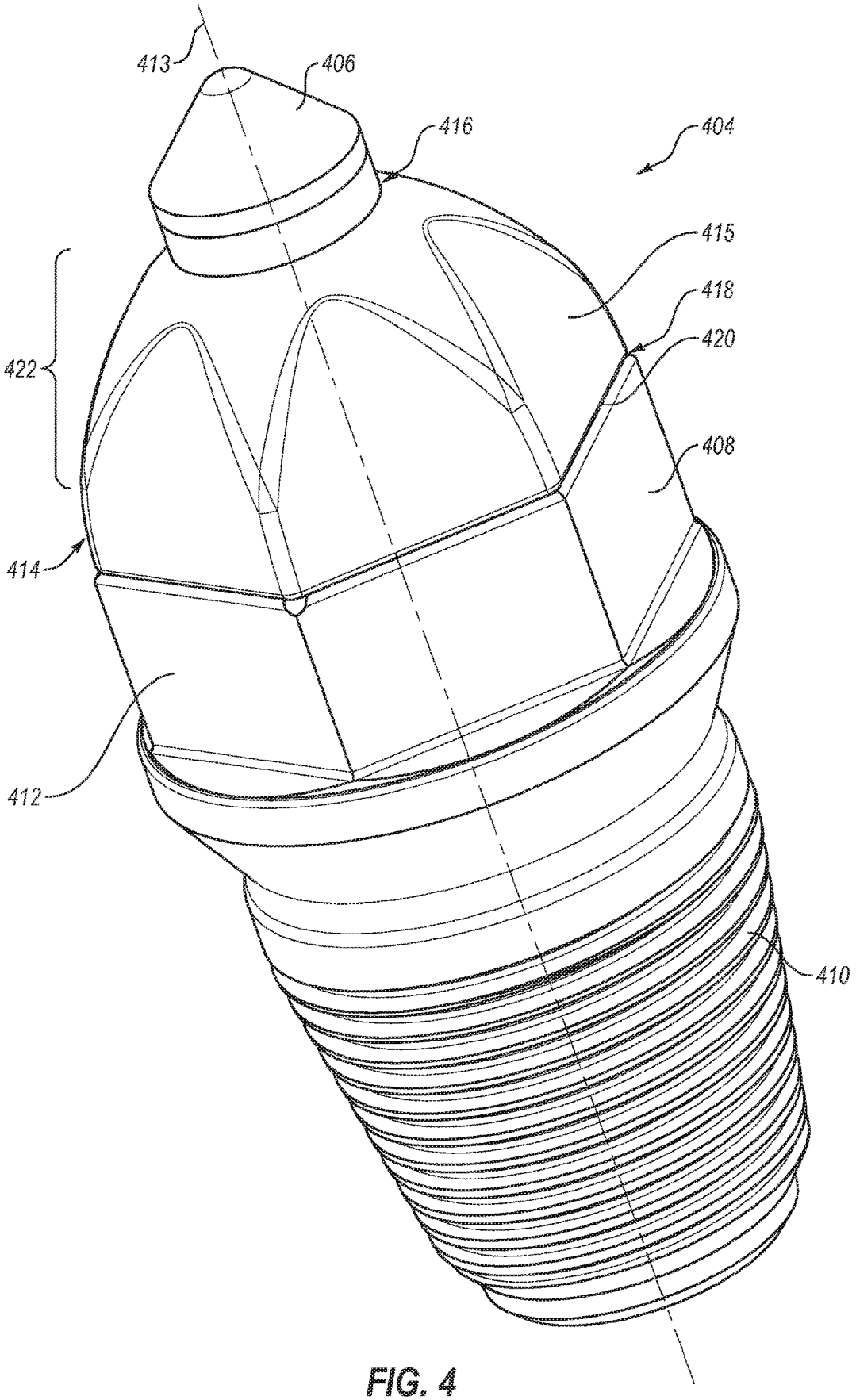
FIG. 4 is a perspective view of a degradation pick, according to at least one embodiment of the present disclosure.

FIG. 4 is a representation of a degradation pick 404, according to at least one embodiment of the present disclosure. The degradation pick 404 may include a hardened tip 406. The hardened tip 406 may be fabricated from an ultrahard material, such as polycrystalline diamond (PCD). As used herein, the term "ultrahard" is understood to refer to those materials known in the art to have a grain hardness of about 1,500 HV (Vickers hardness in kg/mm2) or greater. Such ultrahard materials can include but are not limited to diamond, sapphire, moissanite, hexagonal diamond (Lonsdaleite), cubic boron nitride (cBN), polycrystalline cBN (PcBN), Q-carbon, binderless PcBN, diamond-like carbon, boron suboxide, aluminum manganese boride, metal borides, boron carbon nitride, PCD (including, e.g., leached metal catalyst PCD, non-metal catalyst PCD, and binderless PCD or nanopolycrystalline diamond (NPD)) and other materials in the boron-nitrogen-carbon-oxygen system which have shown hardness values above 1,500 HV, as well as combinations of the above materials. In some embodiments, the ultrahard material may have a hardness values above 3,000 HV. In other embodiments, the ultrahard material may have a hardness value above 4,000 HV. In yet other embodiments, the ultrahard material may have a hardness value greater than 80 HRa (Rockwell hardness A).

The degradation pick 404 may include a pick body 408. The pick body 408 may include an attachment end 410. The attachment end 410 may be configured to attach to a rotatable drum (such as rotatable drum 102 of FIG. 1 or rotatable drum 302 of FIG. 3). For example, in the embodiment shown, the attachment end 410 includes a threaded attachment. In this embodiment, the threaded attachment is inserted into a complementarily threaded bore of the rotating drum or a mounting block attached to the rotating drum (e.g., block 205 of FIG. 2). In other embodiments, the attachment end 410 may be attached to the rotatable drum using any other attachment mechanism, such as via braze, weld, friction fit, interference fit, retaining pin, retaining ring, and so forth.

As used herein, the term longitudinal is to be interpreted as parallel or approximately parallel to a longitudinal axis 413 the degradation pick 404. As used herein, the term transverse is to be interpreted with respect to a width of the degradation pick 404, or transverse to the longitudinal axis 413.

The pick body 408 may include a shank 412. In some embodiments, the shank 412 may be generally cylindrical. In other embodiments, the shank 412 may be non-cylindrical, or in other words, have a non-circular transverse cross-sectional shape. For example, in the embodiment shown, the shank 412 may have a hexagonal shape. Torque adjustment tools (e.g., wrench, socket) are designed to engage with an engagement feature of the pick body 408 with a specific shape in mind, such as a hexagon. Therefore, by making the shank 412 in the shape of the engagement feature, a similar shape and size torque adjustment tool may be used to install, tighten, loosen, and remove the degradation pick 404. For example, the hexagonal shank 412 shown may be used with a hexagonal torque adjustment tool.

The pick body 408 may be fabricated from steel. In this manner, the pick body 408 may be installed and tightened on the rotating drum. Material removed by the hardened tip 406 may travel at high velocities, because the material is thrown by the degradation pick 404 as the rotating drum rotates, the material releases energy when fractured and the released energy accelerates the broken pieces away from the formation. Some of that broken material may hit, scrape, or otherwise engage the pick body 408. This may erode and/or wear down the pick body 408. In some embodiments, at least one feature of the shank 412 may be eroded and/or worn down such that the at least one feature is unrecognizable and/or useless. For example, the edges of a hexagonal shank 412 may be worn down such that a torque adjustment tool cannot engage the shank 412.

A bolster 414 may be placed between the hardened tip 406 and the pick body 408. In at least one embodiment, a body 415 of the bolster 414 may be fabricated from a wear and/or erosion resistant material, such as tungsten carbide (including cemented tungsten carbide cobalt (WCCo) and tungsten carbides with other metal additives such as nickel, titanium, vanadium, niobium, tantalum, chromium, etc.), cubic boron nitride, other carbides, other carbide matrix materials, abrasive resistant alloy steels (e.g., CPM steels (CPM is a trademark of Crucible Industries LLC); wear resistant steels, e.g., Stellite (Stellite is a trademark of Kennametal Inc.; e.g., cobalt-chromium alloys having high wear resistance), other wear and/or erosion resistant materials, or combinations of the foregoing. In other embodiments, the bolster 414 may be fabricated from an ultrahard material. As used herein, the term "ultrahard" is understood to refer to those materials known in the art to have a grain hardness of about 1,500 HV (Vickers hardness in kg/mm2) or greater. Such ultrahard materials can include but are not limited to diamond (including hexagonal diamond (Lonsdaleite), polycrystalline diamond (PCD) e.g., leached metal catalyst PCD, non-metal catalyst PCD, or binderless PCD or nanopolycrystalline diamond (NPD), etc.), sapphire, moissanite, cubic boron nitride (cBN) (including polycrystalline cBN (PcBN), binderless PcBN, etc.), Q-carbon, diamond-like carbon, boron suboxide, aluminum manganese boride, other metal borides, boron carbon nitride or other materials in the boron-nitrogen-carbon-oxygen system which have hardness values above 1,500 HV, as well as combinations of the above materials. In some embodiments, the ultrahard material may have a hardness values above 3,000 HV. In other embodiments, the ultrahard material may have a hardness value above 4,000 HV. In yet other embodiments, the ultrahard material may have a hardness value greater than 80 HRa (Rockwell hardness A).

In some embodiments, the bolster 414 may engage at least some of the broken material before it hits the pick body 408, thereby at least partially protecting the pick body 408. For example, at least some of the material broken by the hardened tip 406 may travel from the hardened tip 406 backwards towards the pick body 408. By placing the bolster 414 between the hardened tip 406 and the pick body 408, the bolster 414 may deflect at least some of this broken material so that it does not contact the pick body 408. Because the bolster 414 is fabricated from a wear and/or erosion resistant material, the bolster 414 may help to reduce and/or eliminate wear on the pick body 408, including reducing and/or eliminating wear on the shank 412.

In at least one embodiment, one or more sections of the wear and/or erosion resistant material may be attached to the bolster body 415. Wear and/or erosion resistant materials may be attached to the bolster body 415 using any attachment mechanism, including mechanical fasteners, braze, weld, press fit, interference fit, locking pin, snap ring, any other attachment mechanism, or combinations of the foregoing. The wear and/or erosion resistant materials may be attached to the bolster body 415 along a rotational axis of the rotatable drum to which the degradation pick 404 is attached. In this manner, the wear and/or erosion resistant materials may protect the shank 412 at the highest wear point. In other embodiments, the wear and/or erosion resistant materials may be attached to the bolster body 415 off the rotational axis of the rotatable drum.

In some embodiments, the hardened tip 406 may be brazed to the bolster body 415 at a bolster first end 416. In some embodiments, a first bolster transverse cross-sectional shape at the bolster first end 416 may be complementary to a hardened tip transverse cross-sectional shape. For example, the hardened tip 406 may have a circular hardened tip transverse cross-sectional shape, and the bolster first end 416 may have a circular first bolster transverse cross-sectional shape. In other examples, the hardened tip 406 may have a non-circular cross-sectional shape, including triangular, square, pentagonal, hexagonal, septagonal, octagonal, a polygon with nine, ten, eleven, twelve, or more sides, non-polygonal shapes, and any other shape. In some embodiments, a hardened tip transverse cross-sectional area may be the same or about the same as a first bolster transverse cross-sectional area of the bolster body 415 at the bolster first end 416. In other embodiments, the hardened tip transverse cross-sectional area may be greater than or less than the first bolster transverse cross-sectional area.

The bolster body 415 may include a bolster second end 418 opposite the first end 416. In other words, the bolster first end 416 may be located distally from, or further away from the shank 412, the bolster second end. The bolster 414 may be connected to the pick body 408 at an intersection 420 between the bolster second end 418 and the shank 412. The shank 412 may include a shank transverse cross-sectional shape and the bolster body 415 may include a second bolster transverse cross-sectional shape at the bolster second end 418. In at least one embodiment, the shank transverse cross-sectional shape and the second bolster transverse cross-sectional shape may be the same. For example, the shank transverse cross-sectional shape may be non-circular and the bolster transverse cross-sectional shape may be non-circular. Specifically, and in the embodiment shown, the second bolster transverse cross-sectional shape may be hexagonal, and the shank cross-sectional shape may be hexagonal. As discussed above, a hexagonal shanks 412 may be adjusted by a torque adjustment tool. By making the bolster body 415 have a hexagonal second bolster transverse cross-sectional shape, a torque adjustment tool may pass over the bolster 414 and onto the shank 412. In this manner, the bolster body 415 may be erosion and/or wear resistant and protect the shank 412, while the shank 412 may be ductile and tighten against a mounting block. In other examples, the second bolster transverse cross-sectional shape may be triangular, square, pentagonal, hexagonal, heptagonal, octagonal, polygonal of 9, 10, 11, 12, or more sides, ellipsoidal, curved with multiple concavities, non-polygonal including straight and curved sections, and any other non-circular shape. Different conditions, including material type, impact velocity, temperature, humidity, and so forth, may change the dynamics of material deflection by the bolster 414, and therefore may change the optimal second bolster transverse cross-sectional shape.

For the purposes of this disclosure, rotationally symmetric may be interpreted to mean symmetric at each point around a central axis, such as a circle. Radially symmetric may be interpreted to mean symmetric at multiple even radial points around a circle, such as an ellipse, triangle, square, pentagon, any sided polygon, or any shape that includes regular features, cut-outs, and so forth along an edge. Non-rotationally symmetric may be interpreted to mean no symmetry at any two radial points about a circle, such as a circle with a bulge in it, a square with a protrusion out of only one side, or any other non-rotationally symmetric shape. In some embodiments, the second bolster transverse cross-sectional shape may be radially symmetric about a central axis with three, four, five, six, seven, eight, nine, ten, or more radial points of symmetry. In other embodiments, the second bolster transverse cross-sectional shape may be non-rotationally symmetrical. In still other embodiments, the second bolster transverse cross-sectional shape may have one, two, three, four, five, six, seven, eight, nine, ten, or more planes of symmetry that pass through the central axis. In other examples, the second bolster transverse cross-sectional shape may be non-symmetric, or have no planes of symmetry and no rotational or radial symmetry.

The shank 412 has a shank transverse cross-sectional area and the bolster body 415 has a second bolster transverse cross-sectional area at the bolster second end 418. In some embodiments, the shank transverse cross-sectional area and the bolster transverse cross-sectional area may be the same or about the same. For example, in the embodiment shown in FIG. 4, the shank transverse cross-sectional shape is hexagonal, and the second bolster transverse cross-sectional shape is hexagonal, and the shank transverse cross-sectional area is about the same as the second bolster transverse cross-sectional area. In this manner, a user may install the degradation pick 404 sliding a torque adjustment tool over the hardened tip 406, the bolster 414, and the shank 412. The torque adjustment tool may then engage the shank 412 and/or the bolster 414 during installation of the degradation pick 404. Therefore, shaping at least the bolster second end 418 to match the size and shape of the shank 412 may assist in installation and removal of the degradation pick 404.

In other embodiments, the bolster second end 418 may have a different second bolster transverse cross-sectional shape than the shank transverse cross-sectional shape. For example, the second bolster transverse cross-sectional shape may be circular, and the shank transverse cross-sectional shape may be hexagonal. In other examples, the second bolster transverse cross-sectional shape may be hexagonal and the shank transverse cross-sectional shape may be circular.

In some embodiments, the bolster second end 418 may have a different second bolster transverse cross-sectional area than the shank transverse cross-sectional area. For example, the second bolster transverse cross-sectional area may be greater than or less than the shank transverse cross-sectional area.

In some embodiments, the first bolster transverse cross-sectional shape at the bolster first end 416 and the second bolster cross-sectional shape at the bolster second end 418 may be the same. In other embodiments, the first bolster transverse cross-sectional shape and the second bolster cross-sectional shape may be different. For example, the first bolster transverse cross-sectional shape may be circular, and the second bolster transverse cross-sectional shape may be hexagonal. In this manner, the bolster body 415 may have similar transverse cross-sectional shapes and/or areas to both the hardened tip 406 and the shank 412. In other words, similar bolster transverse cross-sectional shapes and pick body cross-sectional shapes may include at least one feature, such as a protrusion, indentation, curved edge, straight edge, that is the same shape, size, thickness, width, or combinations of the foregoing. In at least one embodiment, similar features may be aligned on the bolster 414 and the shank 412. In other embodiments, similar features may be misaligned on the bolster 414 and the shank 412.

In some embodiments, the first bolster transverse cross-sectional area may be different from the second bolster transverse cross-sectional area. For example, the first bolster transverse cross-sectional area may be smaller than the second bolster transverse cross-sectional area.

If the first bolster transverse cross-sectional shape is different from the second bolster transverse cross-sectional shape and/or the first bolster transverse cross-sectional area is different from the second bolster transverse cross-sectional area, the bolster body 415 may include a transition region 422 between the bolster first end 416 and the bolster second end 418. In some embodiments, the transition region 422 may extend from the bolster first end 416 to the bolster second end 418. In other embodiments, the transition region 422 may extend from a point between the bolster first end 416 and the bolster second end 418 to the bolster second end 418. In other embodiments, the transition region 422 may extend from the bolster first end 416 to a point between the bolster first end 416 and the bolster second end 418. In yet other embodiments, the transition region 422 may extend between the bolster first end 416 and the bolster second end 418 without extending to either the bolster first end 416 or the bolster second end 418.

In some embodiments, the transverse cross-sectional area of the bolster body 415 may change gradually in the transition region 422 between the bolster first end 416 and the bolster second end 418. In other embodiments, the transverse cross-sectional area of the bolster body 415 may change suddenly at a point between the bolster first end 416 and the bolster second end 418. For example, the transition region 422 may include one or more ledges or ribs between the bolster first end 416 and the bolster second end 418.

In some embodiments, the bolster transverse cross-sectional shape may change gradually in the transition region 422 between the bolster first end 416 and the bolster second end 418. For example, in the embodiment shown, as the bolster transverse cross-sectional area increases along the transition region 422, the bolster transverse cross-sectional shape may begin to include the flat sections of the hexagonal second bolster cross-sectional shape. In other embodiments, the bolster transverse cross-sectional shape may change suddenly at a point between the bolster first end 416 and the bolster second end 418.

Figure 5:
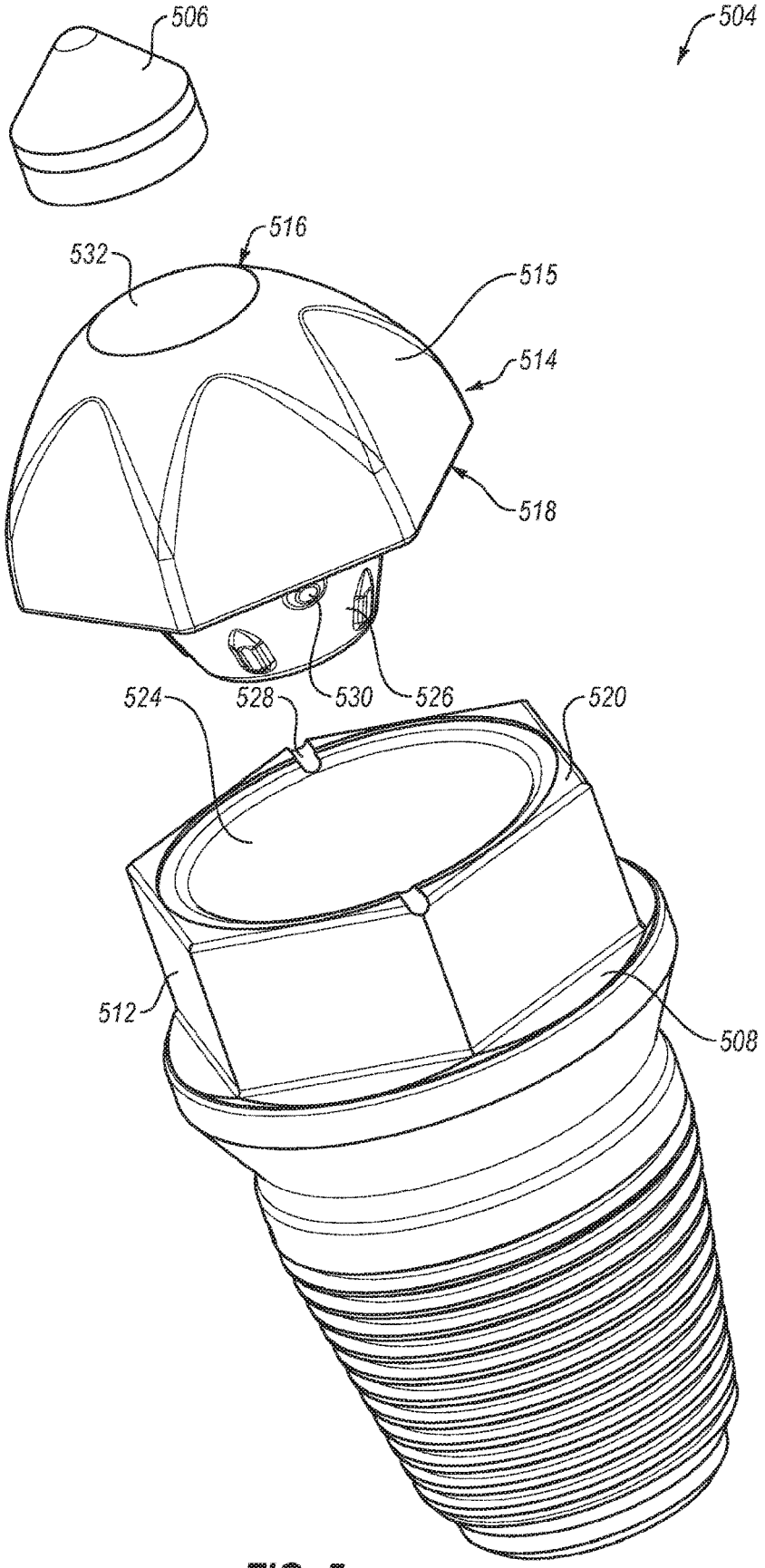
FIG. 5 is an exploded view of a degradation pick, according to at least one embodiment of the present disclosure.

FIG. 5 is an exploded view of a degradation pick 504, according to at least one embodiment of the present disclosure. The degradation pick 504 may include at least some of the same features and characteristics as the degradation pick described in relation to FIG. 4. A pick body 508 may include a bore 524. The bore 524 may extend partially or completely through a shank 512. A bolster 514 may include a protrusion 526 protruding from a bolster body 515. The protrusion 526 may be configured to be inserted into the bore 524, and the protrusion 526 brazed to the bore 524. Thus, the bolster 514 may be brazed to the pick body 508 and the shank 512. In some embodiments, the bolster 514 may be connected to the pick body 508 using a mechanical connection, such as a threaded connection, a locking feature, a pin, heat fit, press fit, interference fit, or other mechanical connection. In other embodiments, the bolster 514 may be brazed to the pick body 508 with a flat connection, or in other words, without a protrusion 526 and a bore 524.

The pick body 508 may include an interface 520 where the pick body contacts the bolster body 515. The interface 520 may include one or more pick body alignment features 528. Matching bolster alignment features 530 may be located on the bolster body 515. When the one or more pick body alignment features 528 are lined up with the bolster alignment features 530, then the bolster body 515 may be oriented with respect to the pick body 508. For example, in the embodiment shown, the shank 512 has a hexagonal shape, and the bolster body 515 has a hexagonal bolster second end 518. When the one or more pick body alignment features 528 are aligned with the bolster alignment features 530, then the flat sections of the shank 512's hexagonal shape and the flat sections of the bolster second end 518's hexagonal shape may be aligned. This may facilitate proper alignment and installation between the bolster 514 and the pick body 508. In some embodiments, the pick body alignment features 528 may be indentations or protrusions at the interface 520, and the bolster alignment features 530 may be matching protrusions or indentations at the bolster second end 518 or on the protrusion 526.

The bolster body 515 has a bolster first end 516. The bolster first end may include a hardened insert face 532. A hardened insert 506 may be brazed to the hardened insert face 532. In some embodiments, the hardened insert face 532 may be flat, and the hardened insert 506 may be brazed to the flat hardened insert face 532.

Figures 1, 6:
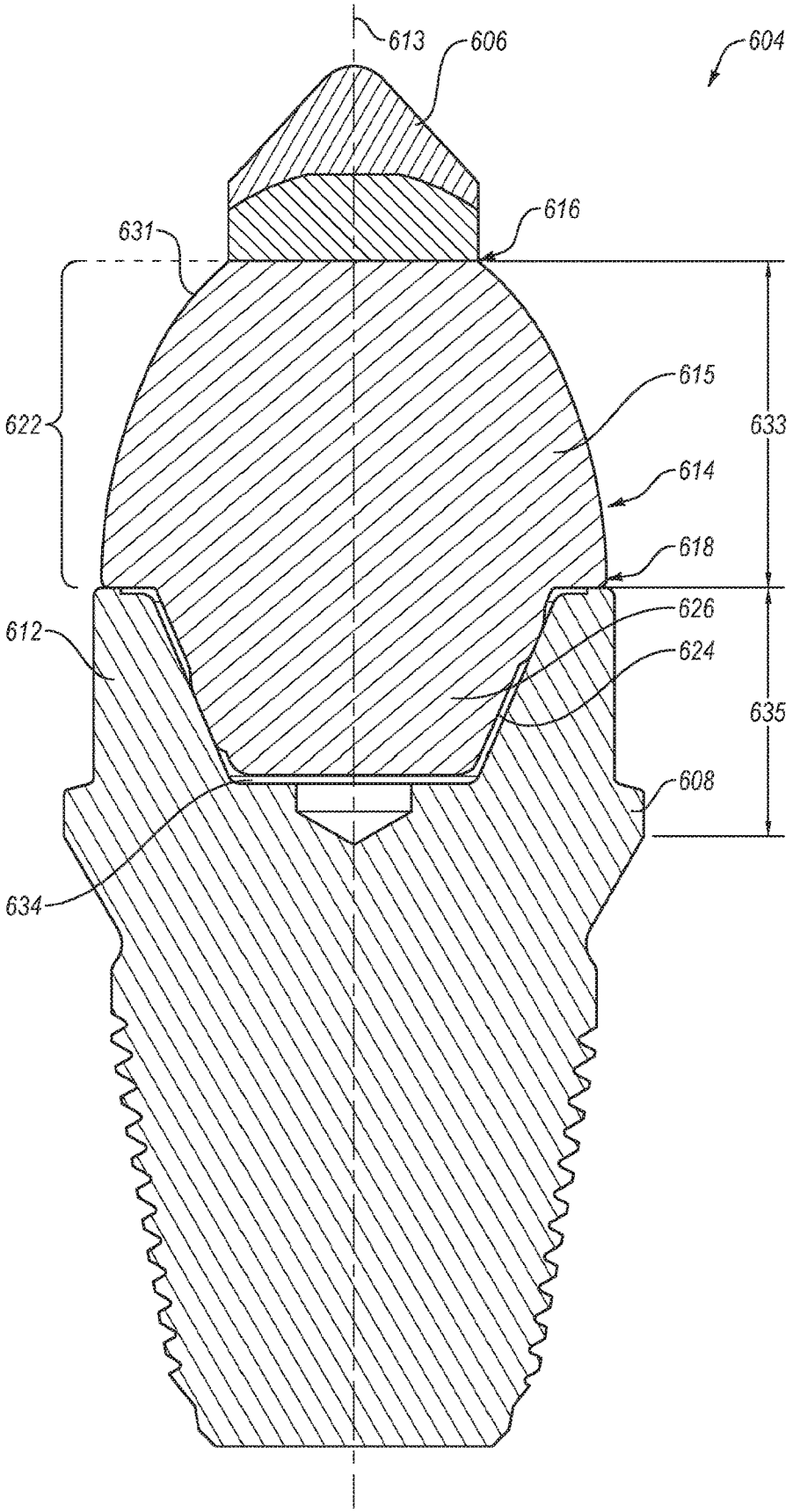
Figures 2, 6:
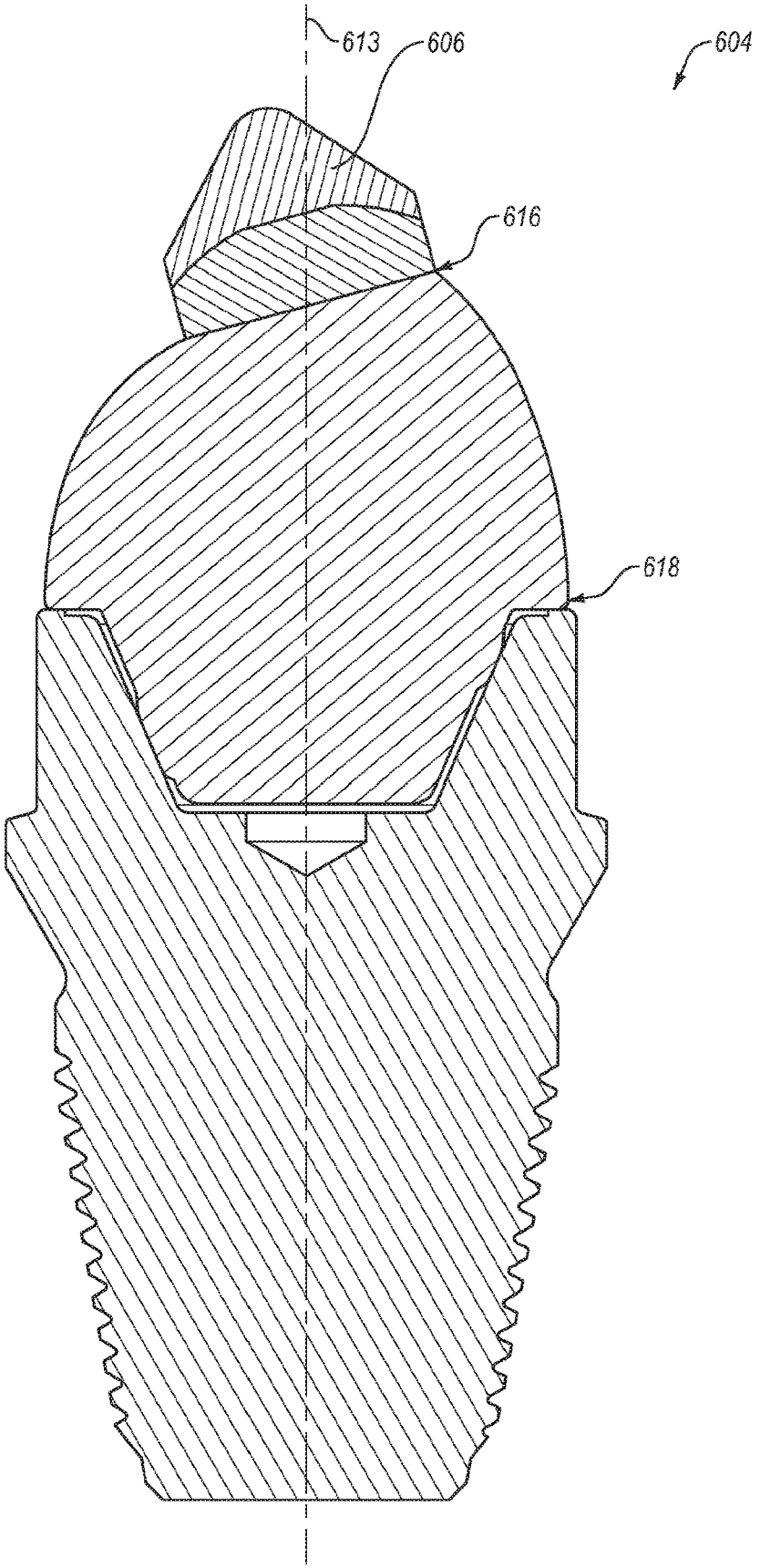
Figures 3, 6:
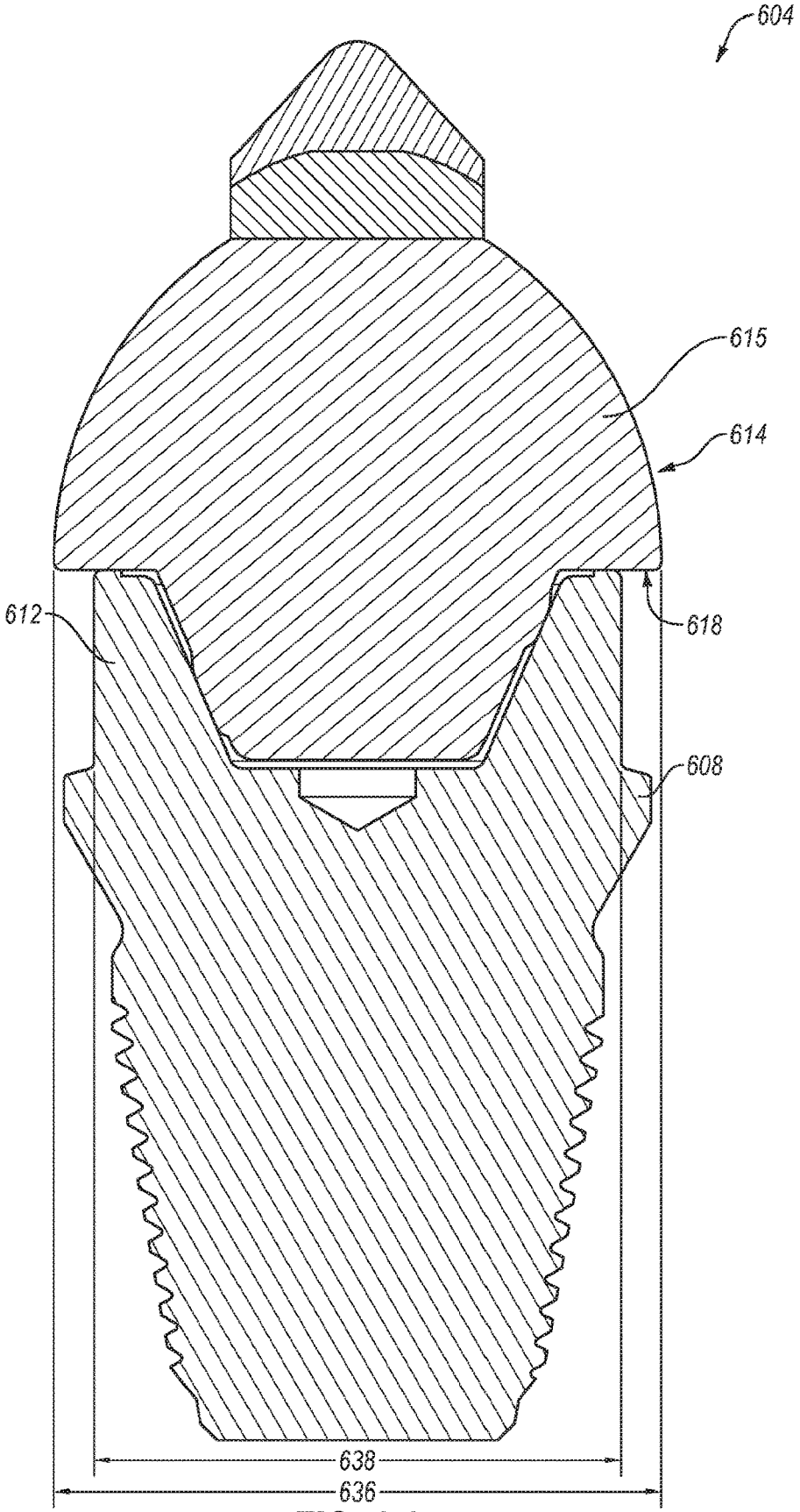

FIG. 6-1 is a representation of a longitudinal cross-section of a degradation pick 604, according to at least one embodiment of the present disclosure. The degradation pick 604 may include at least some of the same features and characteristics as the degradation picks described in relation to FIG. 4 and FIG. 5. The degradation pick 604 may include a bolster 614. The bolster 614 may include a bolster first end 616 opposite the bolster body from a bolster second end 618. In other words, the bolster first end 616 may be located distally from the bolster second end 618, or the bolster second end may be located proximal from the bolster first end 616, relative to a pick body 608. The degradation pick 604 may include a hardened tip 606 brazed to the bolster first end 616 of the bolster body 615. The bolster body 615 may include a protrusion 626 at the bolster second end 618 that is inserted into a bore 624 of the pick body 608. The bolster 614 may be brazed to the pick body 608 at the protrusion 626 and the bore 624.

The bolster first end 616 and the bolster second end 618 may have a different bolster transverse cross-sectional area and/or bolster transverse cross-sectional shape. Somewhere between the bolster first end 616 and the bolster second end 618, the bolster transverse cross-sectional area and/or the bolster transverse cross-sectional shape may be changed in a transition region 622. In the embodiment shown, the transition region 622 is continuous or substantially continuous between the bolster first end 616 and the bolster second end 618. In other words, the longitudinal cross-section of the bolster 616 may be continuous or substantially continuous between the bolster first end 616 and the bolster second end 618. In other embodiments, the transition region 622 may be non-continuous. In other words, the transition region 622 may include one or more ledges, platforms, breaks, or ribs. The transition region may be symmetric along the axis or the transition region may be non-symmetric along the axis (e.g., ovoid).

In some embodiments, the bolster body 615 may be at least partially convex in the transition region 622. In other words, a bolster longitudinal edge 631 in the transition region 622 may be fully or partially convex, or curve away from a longitudinal axis 613. This may further help to deflect fractured material away from the pick body 608. In other embodiments, the bolster 614 may be at least partially concave in the transition region 622. In other words, the bolster longitudinal edge 631 in the transition region 622 may be fully or partially concave, or curve toward the longitudinal axis 613. In some embodiments, the bolster longitudinal edge 631 may be tapered at least partially tapered. In other words, the bolster cross-sectional shape and/or bolster cross-sectional area may change gradually between the bolster first end 616 and the bolster second end 618.

In some embodiments, the bolster first end 616 and one or more of the bolster second end 618 and a protrusion end 634 may be parallel. In other words, the bolster first end 616 may be flat on a first plane, and the bolster second end 618 may be on a second plane, and the first plane may be parallel to the second plane.

The bolster 614 has a bolster length 633. The bolster length 633 may be in a range having an upper value and a lower value, or upper and lower values including any of 0.25 in. (0.64 cm), 0.50 in. (1.27 cm), 0.75 in. (1.91 cm), 1.0 in. (2.54 cm), 1.5 in. (3.81 cm), 2.0 in. (5.08 cm), 2.5 in. (6.35 cm), 3.0 in. (7.32 cm), or any value therebetween. For example, the bolster length 633 may be greater than 0.25 in. (0.64 cm). In other examples, the bolster length 633 may be less than 3.0 in. (7.32 cm). In yet other examples, the bolster length 633 may be any value in a range between 0.25 in. (0.64 cm) and 3.0 in. (7.32 cm). In at least one embodiment, it may be critical that the bolster length 633 is between 0.5 in. and 1.5 in. to provide sufficient protection to the shank 612.

The shank 612 has a shank length 635. The shank length 635 may be in a range having an upper value and a lower value, or upper and lower values including any of 0.50 in. (1.27 cm), 0.75 in. (1.91 cm), 1.0 in. (2.54 cm), 1.5 in. (3.81 cm), 2.0 in. (5.08 cm), 2.5 in. (6.35 cm), 3.0 in. (7.32 cm), 4 in. (10.2 cm), 5 in. (12.7 cm), 6 in. (15.2 cm), 8 in. (20.3 cm), 10 in. (25.4 cm), 12 in. (30.5 cm), 13 in. (33.0 cm), or any value therebetween. For example, the shank length 635 may be greater than 0.50 in. (1.27 cm). In other examples, the shank length 635 may be less than 13 in. (33.0 cm). In yet other examples, the shank length 635 may be any value in a range between 0.50 in. (1.27 cm) and 13 in. (33.0 cm). In at least one embodiment, it may be critical that the shank length 635 is between 1.0 in. and 13 in. to allow a torque adjustment tool to engage with the shank 612.

The degradation pick 604 has a bolster ratio. The bolster ratio may be the ratio of the bolster length 633 to the shank length 635. The bolster ratio may be in a range having an upper value and a lower value, or upper and lower values including any of 1:10, 1:8, 1:6, 1:5, 1:4, 1:3, 1:2, 1:1, 2:1, 3:1, 4:1, 5:1, 6:1, 8:1, 10:1, or any value therebetween. For example, the bolster ratio may be greater than 1:10. In other examples, the bolster ratio may be less than 10:1. In yet other examples, the bolster ratio may be any value in a range between 1:10 and 10:1. In at least one embodiment, it may be critical that the bolster ratio is less than 1:1 so that the bolster 614 may sufficiently protect the shank 612.

FIG. 6-2 is another representation of a longitudinal cross-section of a degradation pick 604, according to at least one embodiment of the present disclosure. The degradation pick 604 may include at least some of the same features and characteristics as the degradation picks described in relation to FIG. 4 through FIG. 6-1. In some embodiments, the bolster first end 616 may not be parallel to the bolster second end 618. In other words, the bolster first end 616 may be non-parallel to the bolster second end 618. For example, the bolster first end 616 may be oriented at an angle relative to the bolster second end 618. Changing the angle of the bolster first end 616 may change the orientation of the hardened tip 606 with respect to the pick longitudinal axis 613. In some embodiments, changing the orientation of the hardened tip 606 with respect to the pick longitudinal axis 613 may change the orientation with which the hardened tip 606 engages the surface (e.g., the surface 307 of FIG. 3). This may increase the efficiency of the degradation pick 604 and/or increase the rate of material removal by the degradation pick 604.

FIG. 6-3 is another representation of a longitudinal cross-section of a degradation pick 604, according to at least one embodiment of the present disclosure. The degradation pick 604 may include at least some of the same features and characteristics as the degradation picks described in relation to FIG. 4 through FIG. 6-2. In some embodiments, at least a portion of the bolster 614 may overhang at least a portion of a pick body 608. In other words, at least a portion of the bolster 614 may have a larger bolster diameter 636 than a shank diameter 638 of the shank 612. In some embodiments, the bolster 614 may have a larger outer circumference than the shank 612. In this manner, the bolster 614 may wear and/or erode a difference between the bolster diameter 636 and the shank diameter 638 before the pick body 608 begins to wear and/or erode. This may further protect the pick body 608 from wear and/or erosion. In this manner, the bolster 614 may be sized to wear for a lifetime, or a portion of a lifetime, of the degradation pick 604 such that the bolster 614 may be worn out when the degradation pick 604 is ready to be replaced.

In some embodiments, the entire bolster 614 may overlap the shank 612. In other embodiments, a portion of the bolster 614 may have a bolster diameter 636 that is the same as the shank diameter 638 and a portion of the bolster 614 that has a bolster diameter 636 that is greater than the shank diameter 638. For example, a hexagonal shank 612 may have six flat sides. The bolster second end 618 may include at least one side that is complementary to one flat side of the shank 612 and at least one side that overhangs the shank 612. This may still allow for a tool, such as a socket, to pass over the bolster 614 and engage the shank 612 for installation of the degradation pick 604.

Figures 1, 7:
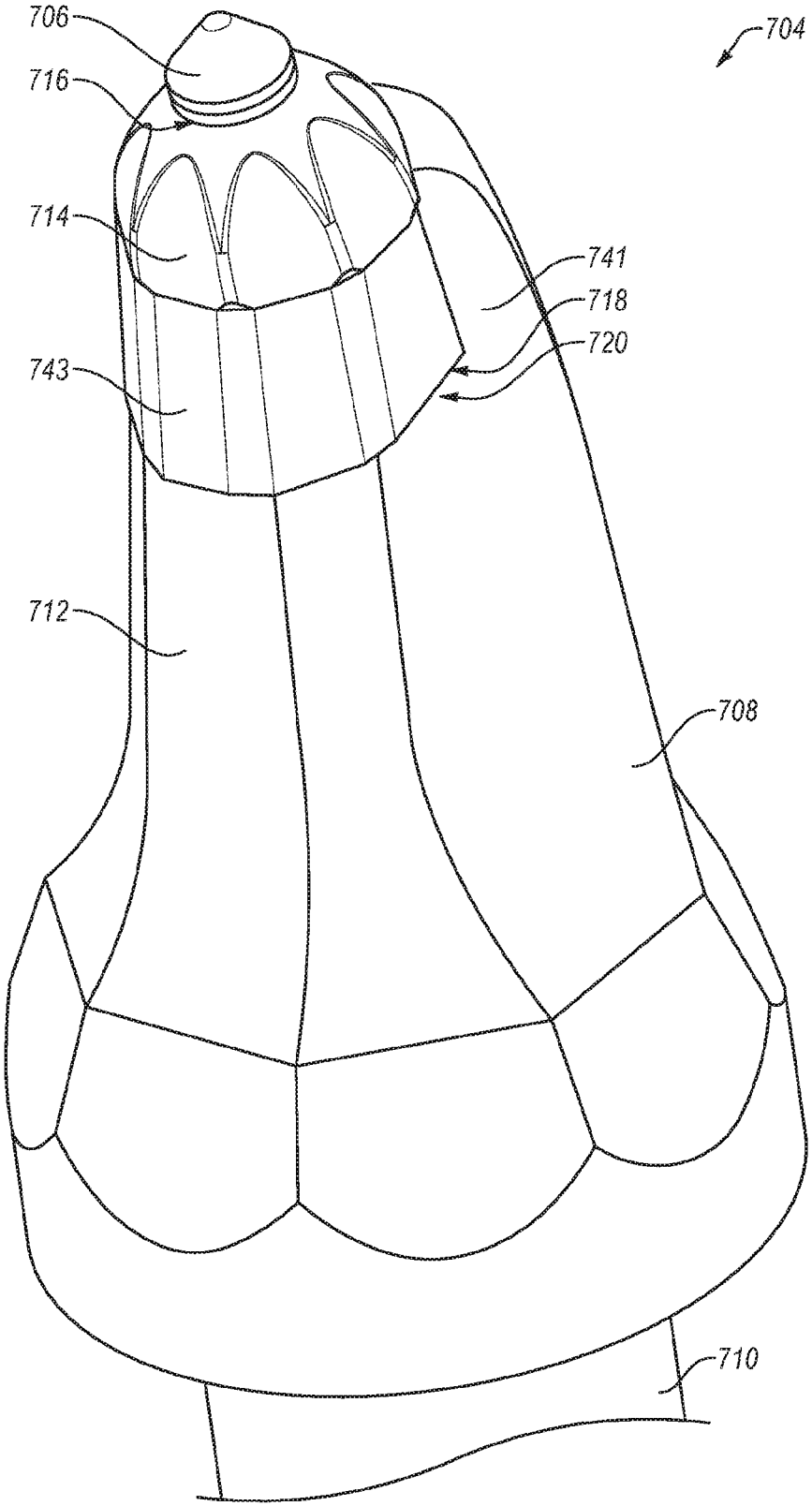
Figures 2, 7:
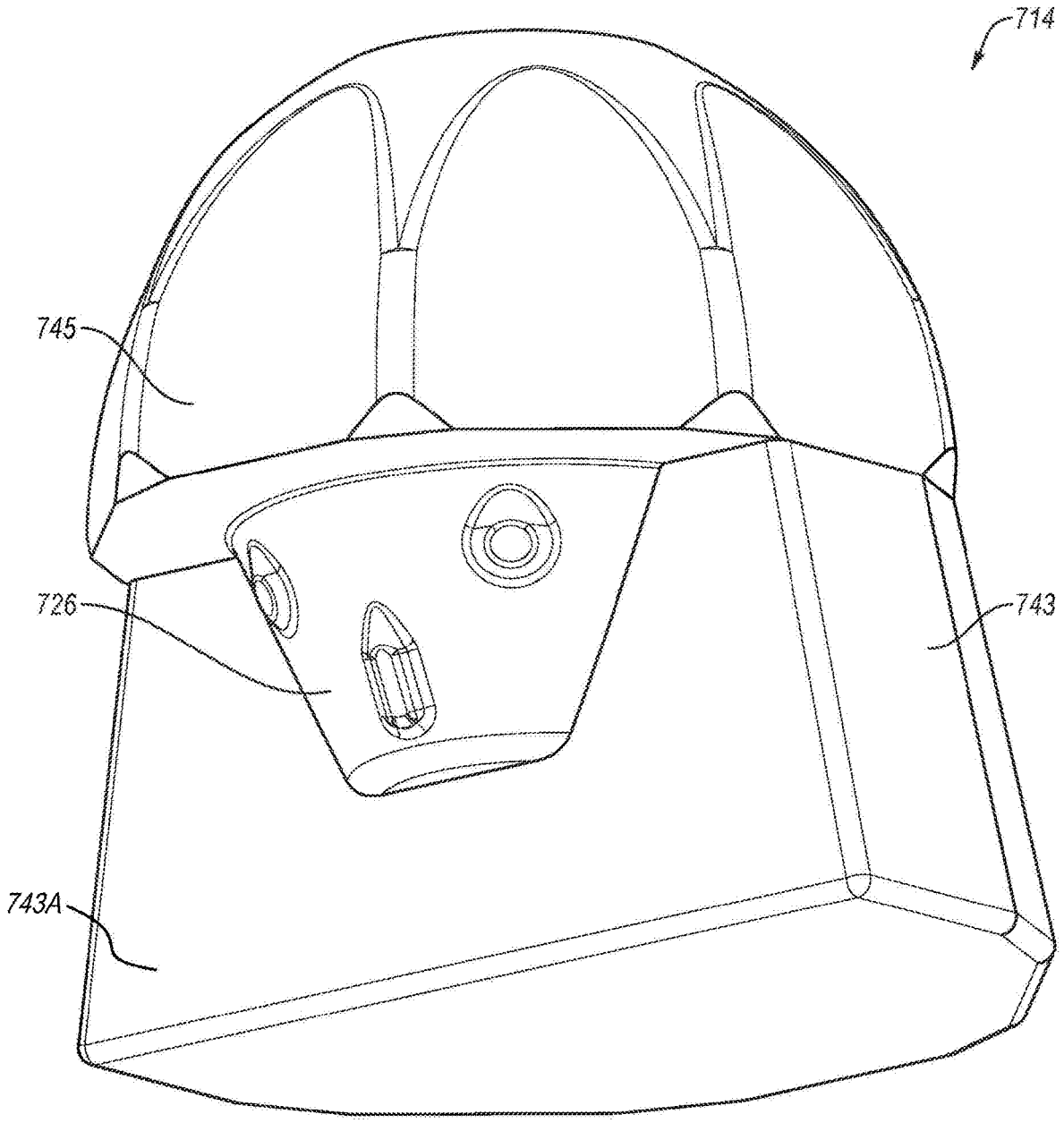

FIG. 7-1 is a representation of a degradation pick 704, according to at least one embodiment of the present disclosure. In some embodiments, the degradation pick 704 may be angled to present the hardened tip 706 to the material to be degraded at an angle different from the longitudinal axis. In some embodiments, the pick body 708 may be oriented with a pick body longitudinal axis that is different from an attachment longitudinal axis of the attachment end 710. In the same or other embodiments, the connection 720 may be angled relative to the pick body longitudinal axis and/or the attachment longitudinal axis.

In some embodiments, the bolster first end 716 may be parallel to the bolster second end 718. In other embodiments, the bolster first end 716 may be non-parallel to the bolster second end 718.

The pick body 708 may include a bolster support 741. The bolster support 741 may be located behind the bolster 714 and provide support for the bolster 714 during operation of the degradation pick 704. During operation, the forces on the bolster 714 attached to an angled pick body 708 may be greater than on a non-angled pick body. The bolster support 741 may help to prevent the bolster from being dislodged or removed from the pick body 708.

The bolster 714 may include a bolster extension 743. The angled pick body 708 may expose more of the pick body 708 (such as the shank 712) to material fractured during operation of the degradation pick 704. A bolster extension 743 may extend the bolster 714 into the shank 712, which may provide additional protection from fractured material.

FIG. 7-2 is a representation of the bolster 714 of FIG. 7-1, according to at least one embodiment of the present disclosure. The bolster 714 may include a bolster cap 745. A protrusion 726 may protrude from the bottom of the bolster cap 745. A bolster extension 743 may also extend from the bottom of the bolster cap 745. The protrusion 726 may protrude from the side 743A of the bolster extension 743. The protrusion 726 may be configured to protrude into a bore of the pick body 708. In this manner, the bolster 714 may be protected from being dislodged from a pick body by the protrusion 726 and the bolster support 741. In this manner, the bolster 714 may further protect the pick body 708 from wear and/or erosion from material fractured by the degradation pick 704. In some embodiments, the bolster body may be non-rotationally symmetric.

FIG. 8-1 through FIG. 16-2 are representations of bolsters that may be installed on a pick body of a degradation pick. For example, the bolsters shown may include a protrusion (e.g., protrusion 526 of FIG. 5) protruding from the second end (e.g., second end 518 of FIG. 5) of a bolster. The protrusion may be inserted into a bore (e.g., bore 524 of FIG. 5) of a pick body (e.g., pick body 508 of FIG. 5). The bolsters shown may similarly include alignment features (e.g., alignment features 528, 530 of FIG. 5) that may align the bolster with respect to the pick body. Each bolster may include one or more bolster features that may be similar to a pick body feature, such that a torque adjustment tool may slip over the bolster to adjust the torque of the degradation pick by engaging the pick body feature. The pick body may include a shank (e.g., shank 512 of FIG. 5) that may include the pick body feature. The bolsters may include a hardened tip (e.g., hardened tip 506 of FIG. 5) that may be secured to the bolster at the bolster first end (e.g., first end 516 of FIG. 5). The first end and the second end of the bolster may be parallel or non-parallel. The bolster may overlap the shank of the pick body.

Figures 1, 8:
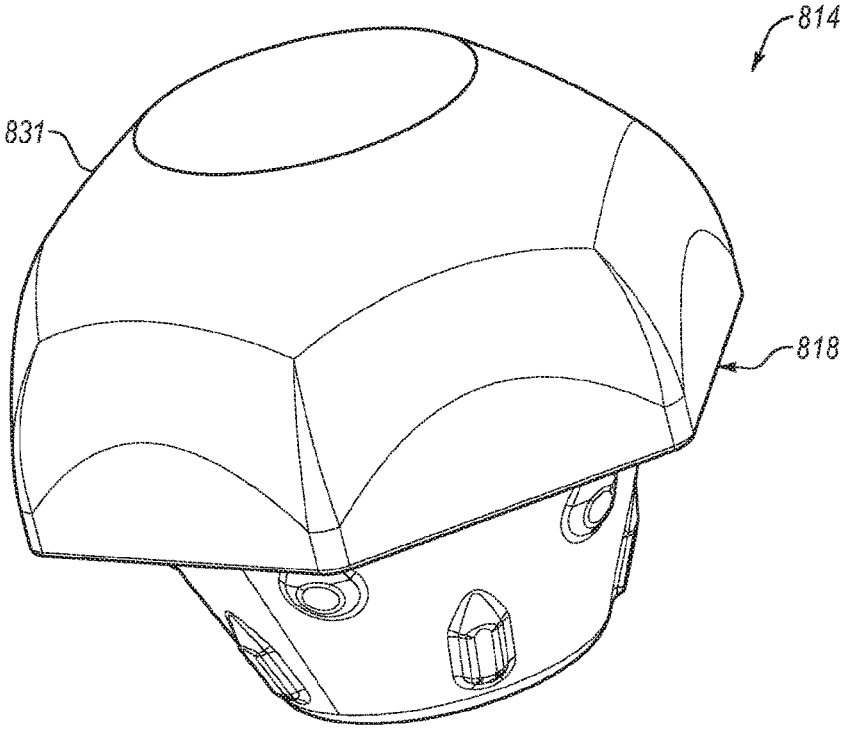
Figures 2, 8:
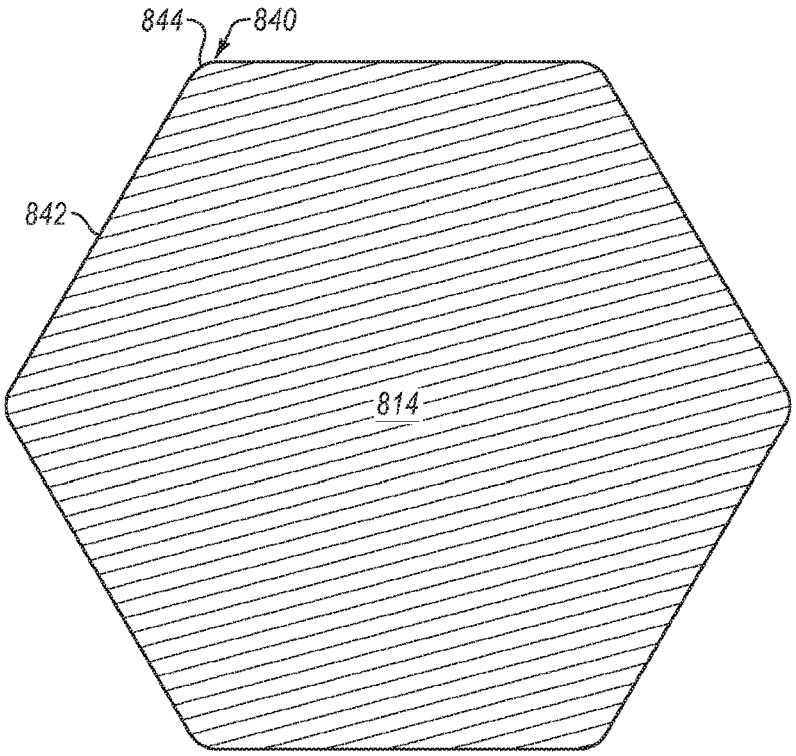

FIG. 8-1 is a perspective view of a bolster 814, according to at least one embodiment of the present disclosure. FIG. 8-2 is a transverse cross-sectional view of the bolster 814 of FIG. 8-1, taken at the bolster second end 818. The bolster 814 may include at least some of the same features and characteristics as the bolsters described in relation to FIG. 4 through FIG. 7. In some embodiments, the bolster 814 may have a hexagonal shape at the bolster second end 818.

In some embodiments, the bolster 814 may have a bolster longitudinal edge 831 that is straight. In other embodiments, the bolster 814 may have a bolster longitudinal edge 831 that is curved. For example, the bolster longitudinal edge 831 may be convex, meaning that the bolster longitudinal edge 831 extends outward from a center of the bolster 814.

The bolster 814 may include at least one bolster feature 840. The bolster feature 840 may be any identifiable feature, such as a straight edge, a point, a bulge, an indentation, or any other identifiable feature. In the embodiment shown, the bolster 814 includes at least twelve bolster features 840: six straight transverse edges 842 and six points 844. The bolster feature 840 may be similar to at least one pick body feature, such as the edges and points of a hexagonal shank (e.g., shank 412 of FIG. 4). For example, the bolster feature 840 may be a straight edge, and the pick body feature may be a straight edge of the same length. In another example, the bolster feature 840 may be a protrusion, and the pick body feature may be a protrusion with the same length, shape, and curvature. Because of the bolster feature 840, the bolster 814 may be non-circular. In the embodiment shown, the bolster 814 is radially symmetric at six points about a longitudinal axis.

In at least one embodiment, the one or more bolster features 840 may be similar to a pick body feature on the shank of a pick body (e.g., shank 412 on the pick body 408 of FIG. 4). For example, the pick body feature may be an engagement feature for a torque adjustment tool to engage and adjust the torque of the pick body. The one or more bolster features 840 may be complementary to the pick body feature such that the torque adjustment tool may slip over the bolster 814 to engage the engagement feature. The one or more bolster features 840 may be the same size, shape, width, length, thickness, or combinations of the foregoing, as the pick body feature. For example, the one or more bolster features 840 may be the same shape and size as the pick body feature. In at least one embodiment, the one or more bolster features 840 may be the same shape, but not the same size as the pick body feature. In the same or other embodiments, the one or more bolster features 840 may be aligned with the pick body feature. In other embodiments, the one or more bolster features 840 may be misaligned with the pick body feature.

Figures 1, 9:
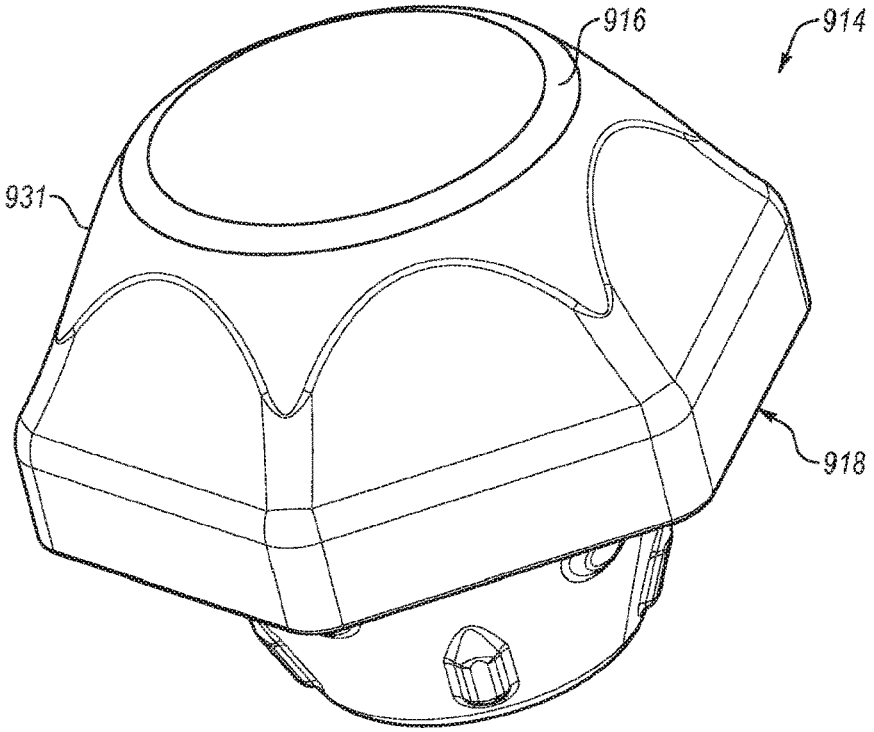
Figures 2, 9:
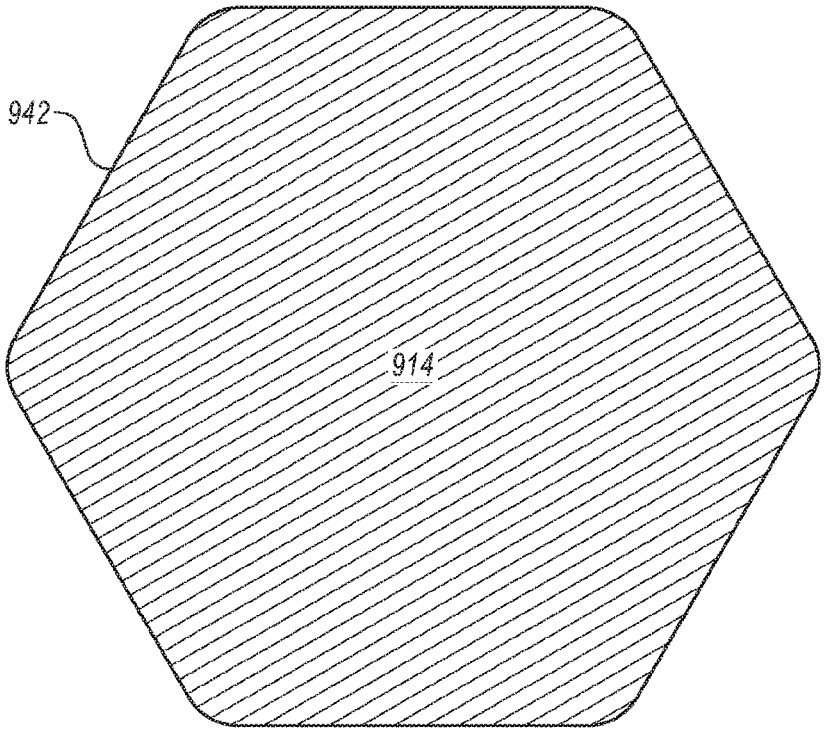

FIG. 9-1 is a perspective view of a bolster 914, according to at least one embodiment of the present disclosure. FIG. 9-2 is a transverse cross-sectional view of the bolster 914 of FIG. 9-1, taken near the bolster second end 918. The bolster 914 may include at least some of the same features and characteristics as the bolsters described in relation to FIG. 4 through FIG. 8-2. In some embodiments, the bolster 914 may have a hexagonal shape at the bolster second end 918. In other words, a bolster second transverse cross-sectional shape may be hexagonal. In some embodiments, a transverse cross-section taken at the bolster second end 918 may be hexagonal with substantially straight transverse edges 942. In the same or other embodiments, a transverse cross-section taken between the bolster second end 918 and the bolster first end 916 may have one or more curved transverse edges 942, as shown in FIG. 9-2. In the embodiment shown, the bolster 914 is radially symmetric at six points about a longitudinal axis.

In some embodiments, the transverse edge 942 may be concave. In other words, the transverse edge 942 may bulge or curve inward toward the center of the bolster 914. The concavity of the second bolster transverse cross-sectional shape may adjust the path taken by material that is deflected by the bolster 914 away from a pick body.

In some embodiments, the bolster 914 may have a bolster longitudinal edge 931 that is straight. In other embodiments, the bolster 914 may have a bolster longitudinal edge 931 that is curved. For example, the bolster longitudinal edge 931 may be concave, meaning that the bolster longitudinal edge 931 extends inward toward a center of the bolster 914.

Figures 1, 10:
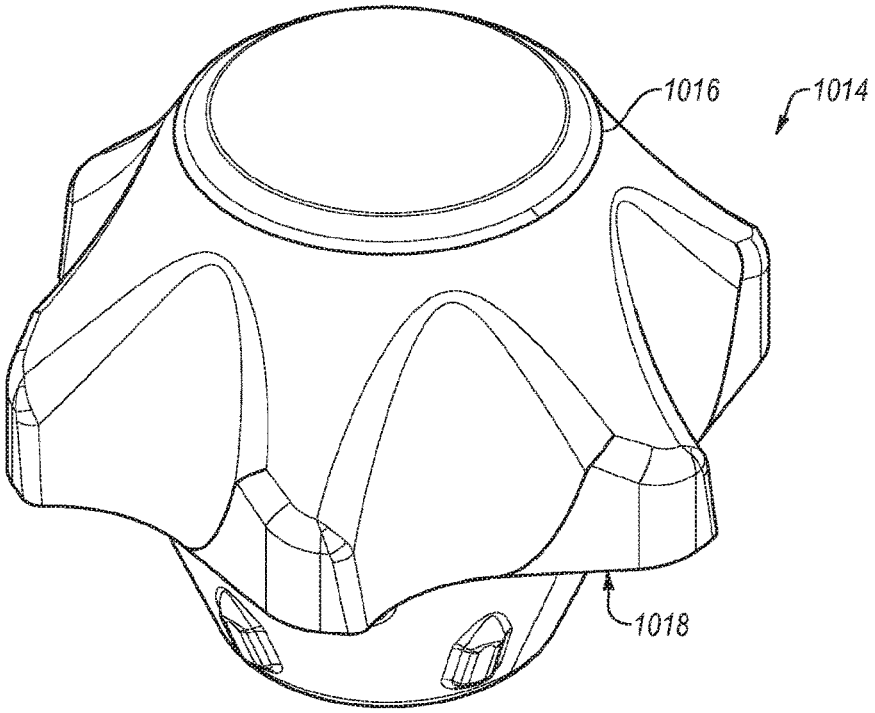
Figures 2, 10:
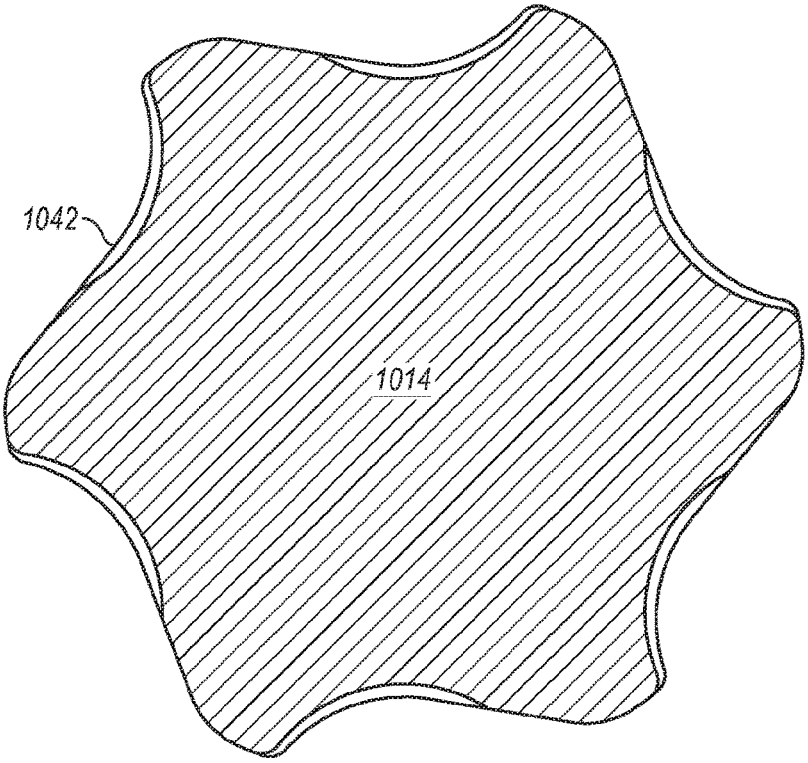

FIG. 10-1 is a perspective view of a bolster 1014, according to at least one embodiment of the present disclosure. FIG. 10-2 is a transverse cross-sectional view of the bolster 1014 of FIG. 10-1, taken at the bolster second end 1018. In at least one embodiment, a transverse cross-section taken at the bolster second end 1018 may have one or more curved transverse edges 1042, as shown in FIG. 10-2.

In some embodiments, one or more of the transverse edges 1042 may be concave. In other words, one or more of the transverse edges 1042 may bulge or curve inward toward the center of the bolster 1014. In some embodiments, the concave transverse edge 1042 may extend from the bolster first end 1016 or near the bolster first end 1016 to the bolster second end 1018. In this manner, the bolster 1014 may resemble the head of a star head screw, or a star head nut. In the embodiment shown, the bolster 1014 is radially symmetric at six points about a longitudinal axis.

Figures 1, 11:
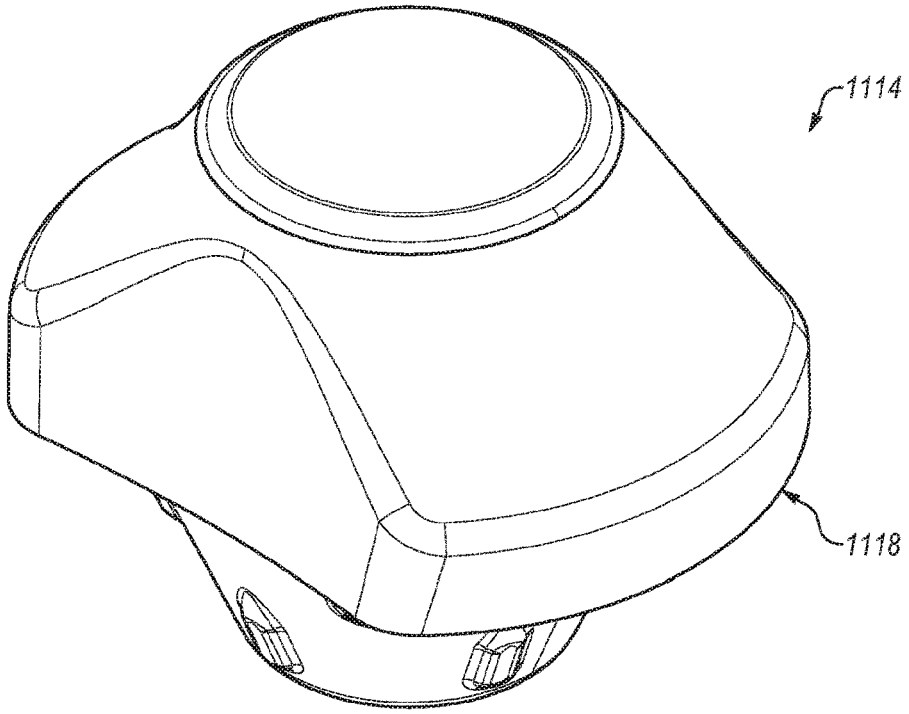
Figures 2, 11:
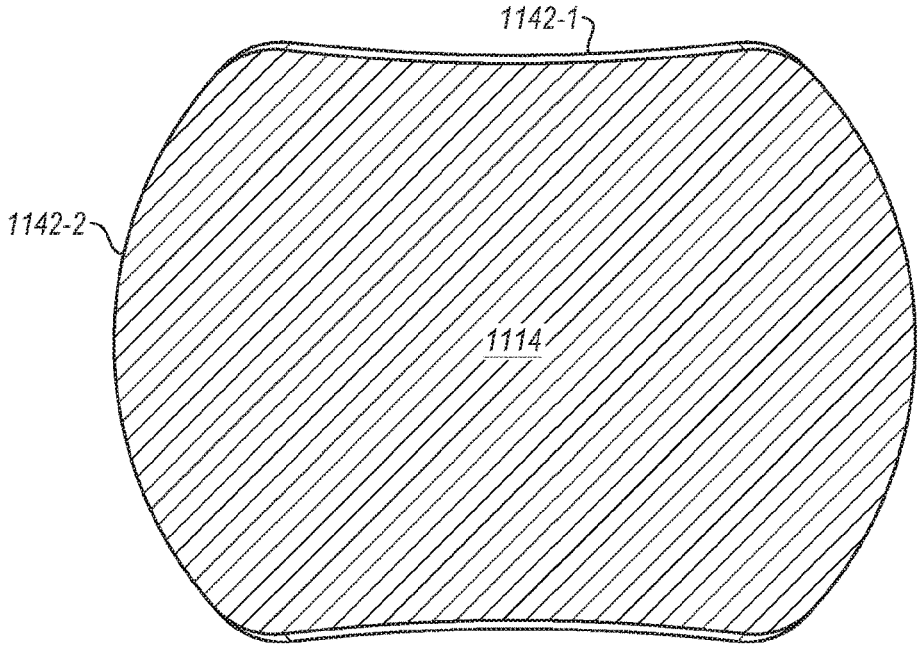

FIG. 11-1 is a perspective view of a bolster 1114, according to at least one embodiment of the present disclosure. FIG. 11-2 is a transverse cross-sectional view of the bolster 1114 of FIG. 11-1, taken at the bolster second end 1118. In at least one embodiment, a transverse cross-section taken at the bolster second end 1118 may have transverse edges 1142-1, 1142-2 that are both curved and straight.

In the embodiment shown, the bolster 1114 may include a first transverse edge 1142-1 that is straight or approximately straight, and a second transverse edge 1142-2 that is curved outward, or convex with respect to the center of the bolster 1114. In this manner, the bolster 1114 may be rectangular with two rounded short edges. Or, in other words, the bolster 1114 may be ellipsoid with straight edges.

In some embodiments, the first transverse edge 1142-1 may be curved. The first transverse edge 1142-1 may be curved in the same direction as the second transverse edge 1142-2. For example, the first transverse edge 1142-1 and the second transverse edge 1142-2 may be curved outward, or convex. In other embodiments, the first transverse edge 1142-1 and the second transverse edge 1142-2 may have different concavities. For example, the first transverse edge 1142-1 may be concave, and the second transverse edge 1142-2 may be convex. In the embodiment shown, the bolster 1114 is radially symmetric at two points about a longitudinal axis.

Figures 1, 12:
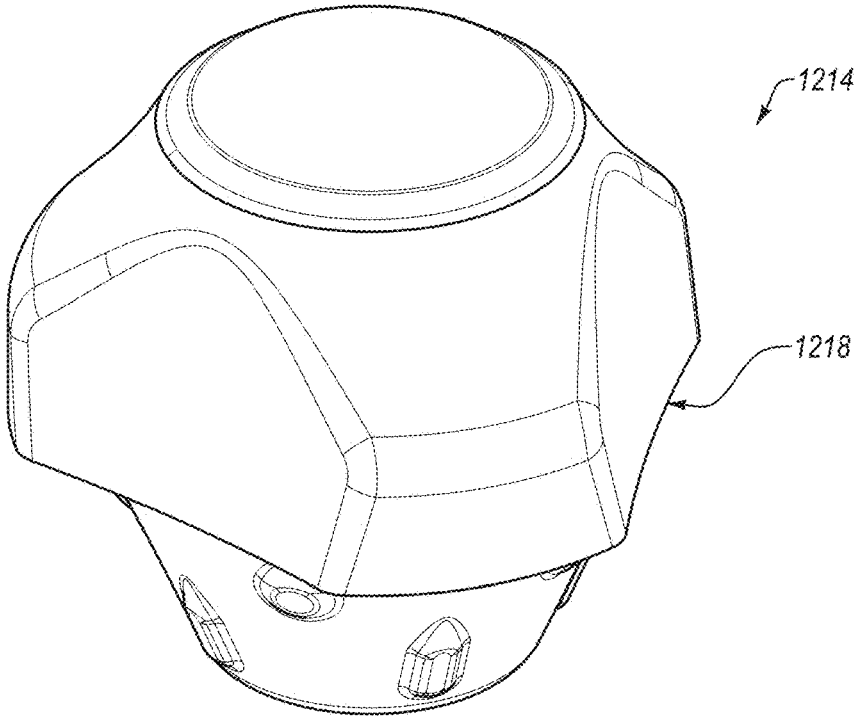
Figures 2, 12:
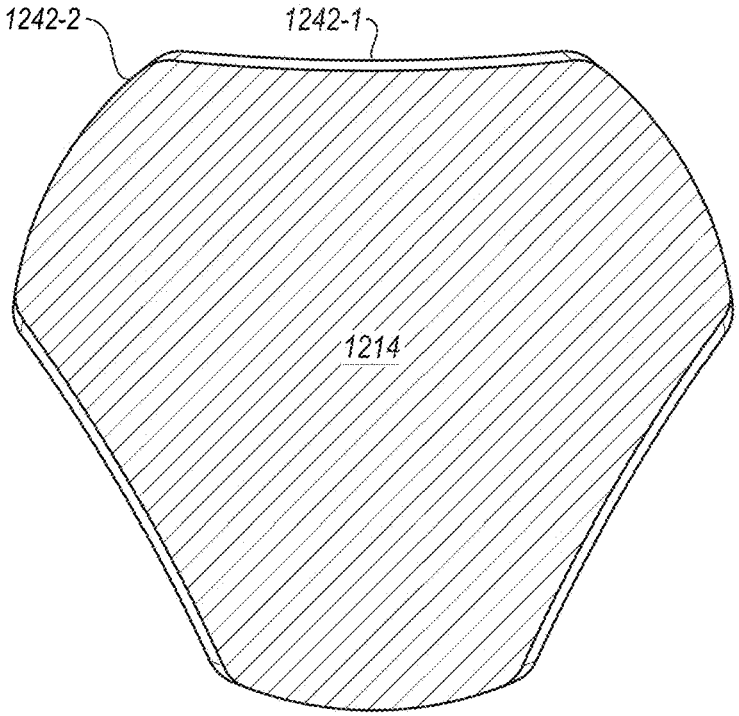

FIG. 12-1 is a perspective view of a bolster 1214, according to at least one embodiment of the present disclosure. FIG. 12-2 is a transverse cross-sectional view of the bolster 1214 of FIG. 12-1, taken at the bolster second end 1218. In at least one embodiment, a transverse cross-section taken at the bolster second end 1218 may have transverse edges 1242-1, 1242-2 that are both curved and straight.

In the embodiment shown, the bolster 1214 includes three straight transverse edges 1242-1, each straight transverse edge 1242-1 being separated by one of three curved transverse edges 1242-2. In this manner, the bolster 1214 may appear to be a triangle with the corners trimmed with a curved radius. In the embodiment shown, the bolster 1214 is radially symmetric at three points about a longitudinal axis.

Figures 1, 13:
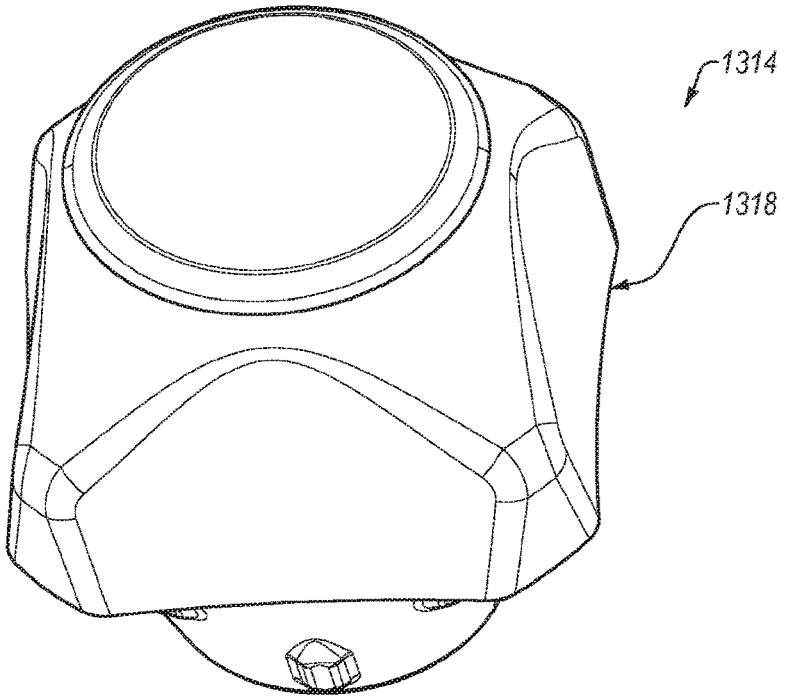
Figures 2, 13:
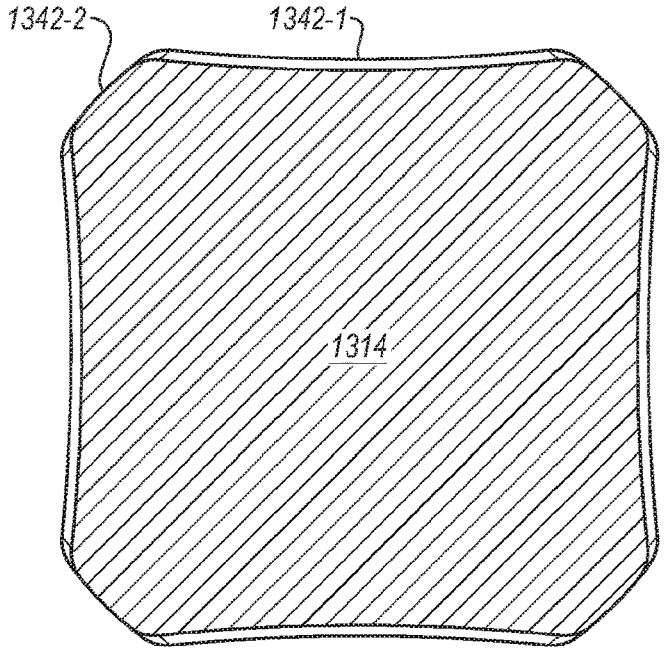

FIG. 13-1 is a perspective view of a bolster 1314, according to at least one embodiment of the present disclosure. FIG. 13-2 is a transverse cross-sectional view of the bolster 1314 of FIG. 13-1, taken at the bolster second end 1318. In at least one embodiment, a transverse cross-section taken at the bolster second end 1318 may have transverse edges 1342-1, 1342-2 that are straight.

The bolster 1314 may have a plurality of first transverse edges 1342-1 and a plurality of second transverse edges 1342-2. In some embodiments, the first transverse edges 1342-1 may have a different length than the second transverse edges 1342-2. For example, the first transverse edges 1342-1 may be longer than the second transverse edges 1342-2. In the embodiment shown, four first transverse edges 1342-1 are separated by four second transverse edges 1342-2. In this manner, the bolster 1314 may appear to be a square with the corners removed. In the embodiment shown, the bolster 1314 is radially symmetric at four points about a longitudinal axis.

Figures 1, 14:
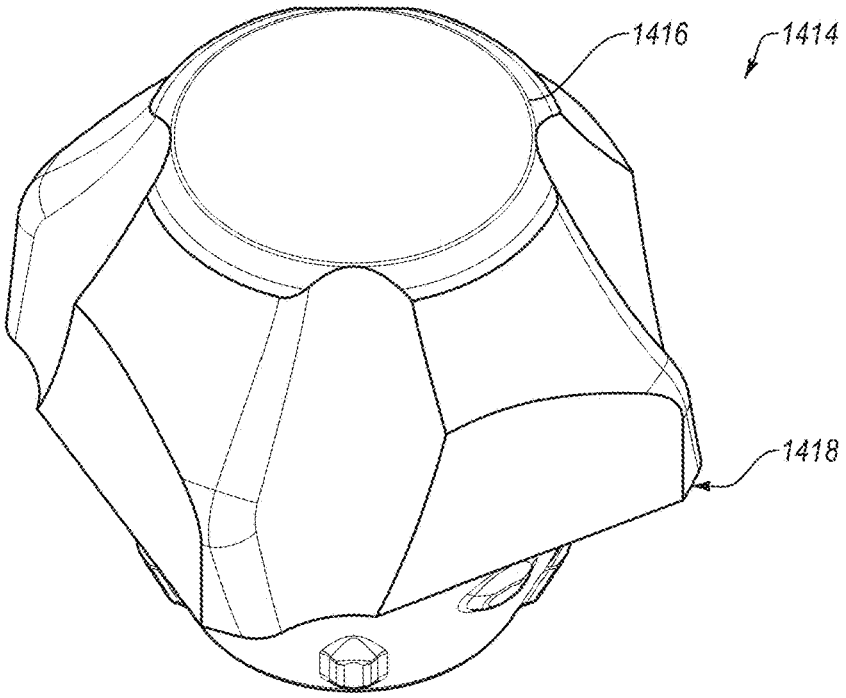
Figures 2, 14:
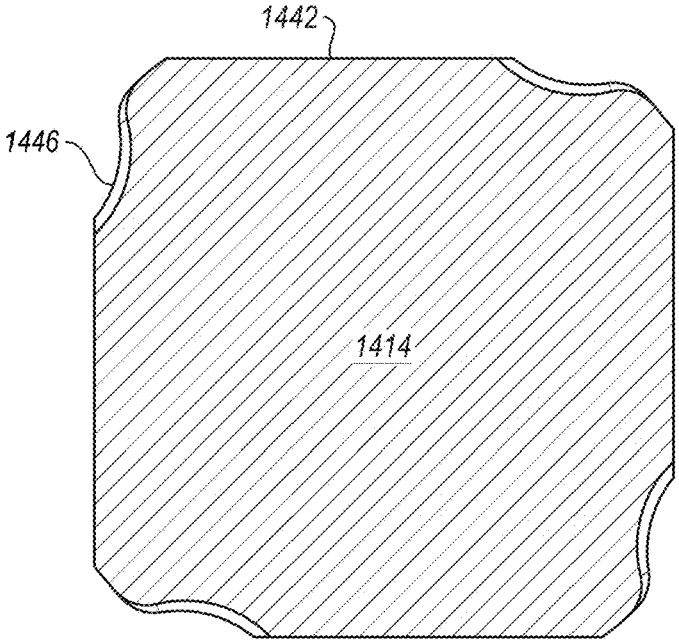

FIG. 14-1 is a perspective view of a bolster 1414, according to at least one embodiment of the present disclosure. FIG. 14-2 is a top down view of the bolster 1414 of FIG. 14-1. In at least one embodiment, the bolster 1414 may have edges 1442 that are planar.

In some embodiments, the plurality of edges 1442 may be planar or approximately planar. In other embodiments, the plurality of edges 1442 may change from straight or planar at the bolster second end 1416 to curved at the bolster first end 1418. One or more of the edges 1442 may include a cut-out 1446. In some embodiments, the cut-out 1446 may extend from the bolster first end 1416 to the bolster second end 1418. In the embodiment shown, the bolster 1414 may include four edges 1442 having four cut-outs taken at or near a corner of each edge. In the embodiment shown, the bolster 1414 is radially symmetric at four points about a longitudinal axis.

Figures 1, 15:
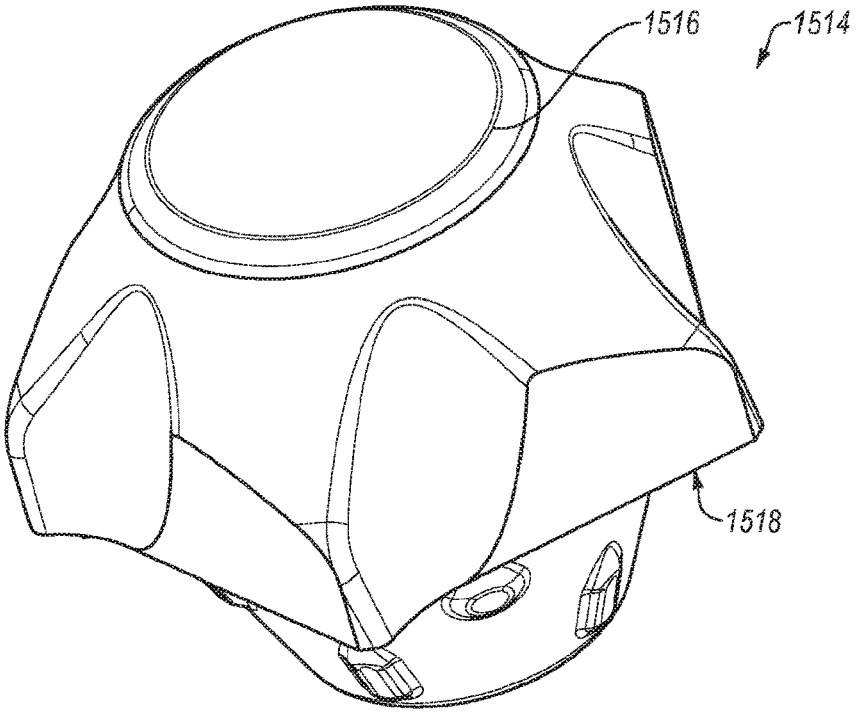
Figures 2, 15:
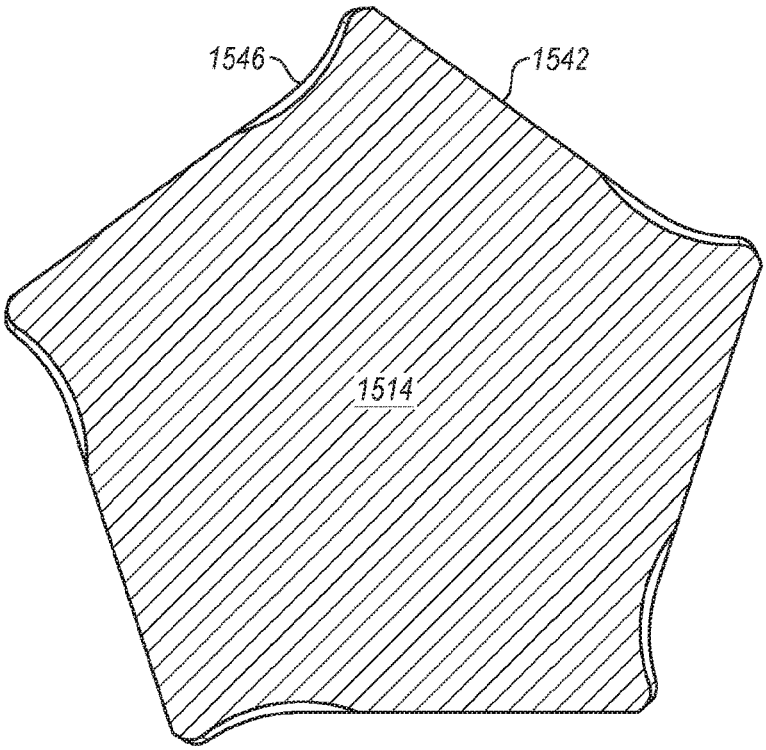

FIG. 15-1 is a perspective view of a bolster 1514, according to at least one embodiment of the present disclosure. FIG. 15-2 is a top down view of the bolster 1514 of FIG. 15-1. In at least one embodiment, the bolster 1514 may have edges 1542 that are planar.

In some embodiments, the plurality of edges 1542 may be planar or approximately planar. In other embodiments, the plurality of edges 1542 may change from straight or planar at the bolster second end 1516 to curved at the bolster first end 1518. One or more of the edges 1542 may include a cut-out 1546. In some embodiments, the cut-out 1546 may extend from the bolster first end 1516 to the bolster second end 1518. In the embodiment shown, the bolster 1514 may include five transverse edges 1542 having five cut-outs taken at or near a corner of each edge. In the embodiment shown, the bolster 1514 is radially symmetric at five points about a longitudinal axis.

Figures 1, 16:
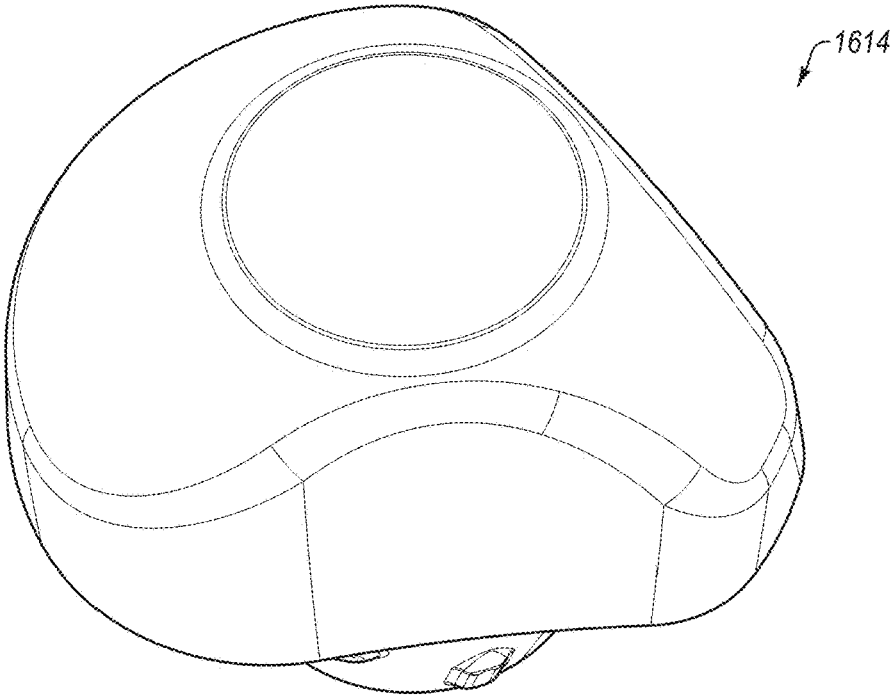
Figures 2, 16:
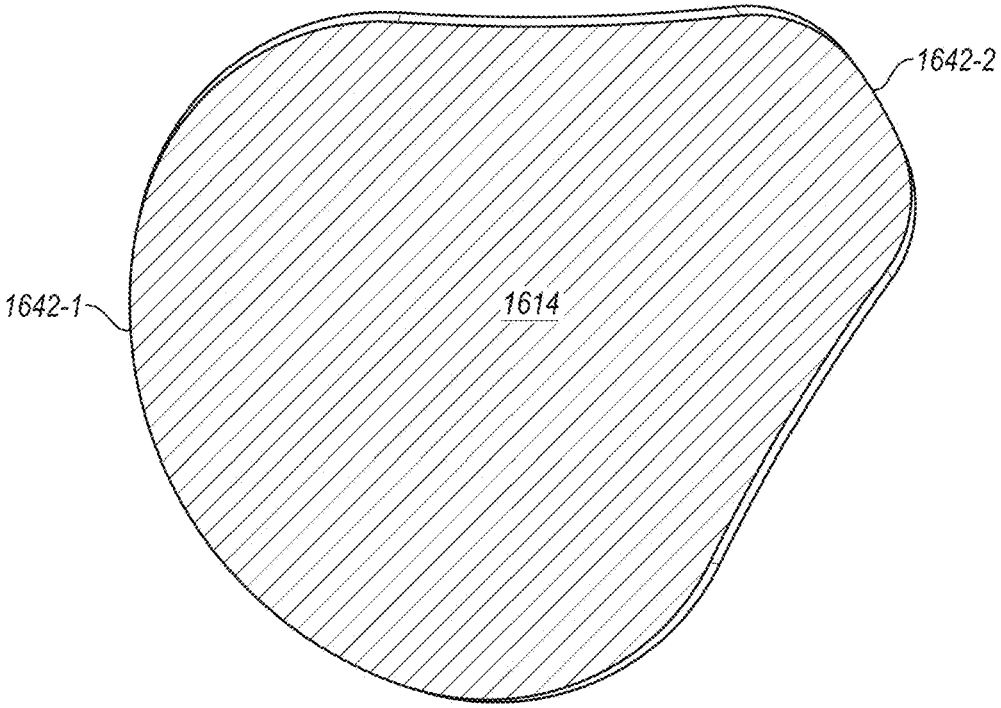

FIG. 16-1 is a perspective view of a bolster 1614, according to at least one embodiment of the present disclosure. FIG. 16-2 is a top down view of the bolster 1614 of FIG. 16-1. In at least one embodiment, the bolster 1614 may have edges (collectively 1642) that are curved, with different edges 1642 having different radii of curvature and/or different concavity.

In the embodiment shown, the bolster 1614 has a first edge 1642-1 with a large radius of curvature and a second edge 1642-2 with a smaller radius of curvature. In this manner, the bolster 1614 may appear to have a bulge or a point at the second edge 1642-2. In some embodiments, the bolster 1614 may include edges having short lengths, long lengths, large radii of curvature, small radii of curvature, or any combination of the foregoing, in any order around an outer circumference of the bolster 1614. In the embodiment shown, the bolster 1614 is non-rotationally symmetric. The side surfaces or longitudinal surfaces between the first and second edges are shown as including a concave curve, however, in this and in other embodiments described above, the side surfaces between the edges may be at least partially straight (e.g., a straight line connects the two radiused edges) or the side surfaces between the edges may include a convex curve (e.g., the line connecting the two radiused edges may be entirely convex). That is, in some embodiments, the side surfaces can be partially concave, entirely concave, entirely straight, partially straight, partially convex, or entirely convex, or combinations of partially concave, partially straight, and/or partially convex.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

It should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. Changes that come within the meaning and range of equivalency of the claims are to be embraced within their scope.

What is claimed is:

1. A bolster for a degradation pick with a pick body having an upper surface and a bolster support extending from the upper surface, the bolster comprising:

a bolster body including a first end, the first end configured to couple to the pick body upper surface at a first interface;

wherein the bolster body further includes:

a bolster cap;

a bolster extension extending in a first direction from a first portion of a bottom of the bolster cap to the first end, the bolster extension including a side face between the bottom of the bolster cap and the first end, the side face configured to couple to the bolster support of the pick body at a second interface; and a protrusion extending in the first direction from a second portion of the bottom of the bolster cap and extending in a second direction from the side face;

wherein the bolster extension extends in the first direction to a level beyond a level to which the protrusion extends.

2. The bolster of claim 1, a bolster transverse cross sectional shape being polygonal.

3. The bolster of claim 1, at least one bolster feature having the same shape and size as at least one pick body feature.

4. The bolster of claim 1, the bolster body further including a second end located distally from the first end, the second end being non-parallel to the first end.

5. The bolster of claim 1, the bolster body further including a second end opposite the first end, a second end cross-sectional shape being different from a first end cross-sectional shape.

6. The bolster of claim 1, the bolster being connected to the pick body using at least one of a mechanical fastener, weld, braze, press fit, heat shrink fit, or interference fit.

7. The bolster of claim 4, a bolster transverse cross sectional shape being polygonal.

8. The bolster of claim 4, at least one bolster feature having the same shape and size as at least one pick body feature.

9. The bolster of claim 4, the bolster being connected to the pick body using at least one of a mechanical fastener, weld, braze, press fit, heat shrink fit, or interference fit.

10. The bolster of claim 5, a bolster transverse cross sectional shape being polygonal.

11. The bolster of claim 5, at least one bolster feature having the same shape and size as at least one pick body feature.

12. The bolster of claim 5, the bolster being connected to the pick body using at least one of a mechanical fastener, weld, braze, press fit, heat shrink fit, or interference fit.

13. The bolster of claim 6, a bolster transverse cross sectional shape being polygonal.

14. The bolster of claim 6, at least one bolster feature having the same shape and size as at least one pick body feature.

* * * * *